United States Patent [19]

Donnelly et al.

[11] Patent Number: 4,978,292

[45] Date of Patent: Dec. 18, 1990

[54] FUEL BURNER CONTROL SYSTEM WITH HOT SURFACE IGNITION

[75] Inventors: Donald E. Donnelly, Glen Carbon, Ill.; Bradley C. Zikes, St. Louis County; Dwain F. Moore, Marlborough; Jeffrey E. Price, St. Louis County; Bartholomew L. Toth, Crestwood, all of Mo.

[73] Assignee: Emerson Electric Co., St. Louis, Mo.

[21] Appl. No.: 488,221

[22] Filed: Mar. 5, 1990

Related U.S. Application Data

[62] Division of Ser. No. 315,919, Feb. 27, 1989, Pat. No. 4,925,386.

[51] Int. Cl.[5] ..... F23N 5/00

[52] U.S. Cl. ..... 431/75; 236/11

[58] Field of Search ..... 236/10, 11; 431/75

[56] References Cited

U.S. PATENT DOCUMENTS

| | | | |
|---|---|---|---|
| 4,773,586 | 9/1988 | Ryan | 236/11 |
| 4,789,330 | 12/1988 | Ballard et al. | 431/75 |
| 4,891,004 | 1/1990 | Ballard et al. | 236/11 X |
| 4,907,737 | 3/1990 | Williams, Jr. | 236/11 |

*Primary Examiner*—William E. Wayner

*Attorney, Agent, or Firm*—Paul A. Becker, Sr.

[57] ABSTRACT

A gas burner control system includes an electrical resistance igniter, gas valve means, and a microcomputer and related circuitry. The microcomputer and related circuitry control energizing of the igniter in such a manner so that the igniter, after successive ignition attempts, will eventually, in response to a learning routine, be heated to a desired ignition temperature. The microcomputer and related circuitry also control operation of a circulator blower in response to burner flame and provide for numerous checks on the integrity of system components.

4 Claims, 11 Drawing Sheets

FUEL BURNER CONTROL SYSTEM WITH HOT SURFACE IGNITION

This application is a division, of application Ser. No. 07/315,919, now U.S. Pat. No. 4,925,386, filed Feb. 27, 1989.

BACKGROUND OF THE INVENTION

This invention relates to fuel burner control systems which utilize an electrical resistance igniter.

Fuel burner control systems with hot surface ignition, wherein a main burner is directly ignited by an electrical resistance igniter, are becoming more widely used. While the prior art discloses various such systems which appear to perform adequately, there is a need to improve the overall performance and reliability of the electrical resistance igniter used therein.

Specifically, the typical electrical resistance igniters utilized in prior art systems generally require between approximately 15 and 45 seconds of electrical energizing to warm up to a temperature sufficiently high to ignite the air-fuel mixture at the burner. While such warm-up times present no particular performance problem, they are a disadvantage with regard to testing the system on the assembly line of the device incorporating the system. Specifically, in the assembly line of the device such as a furnace or boiler utilizing the system, the system is tested to determine that it operates properly. Among tests performed is a test to determine that the igniter does, in fact, attain a temperature sufficiently high to ignite the air-fuel mixture. Therefore, unless normal system function is bypassed or altered in some manner for this test, the igniter will be energized for a time period somewhere between 15 and 45 seconds. Since a test time of 45 seconds, and to a lesser extent, a test time of 15 seconds, are significant cost factors, particularly in a high-volume assembly line, it is desirable to provide an igniter with faster warm-up time so as to reduce such test times.

Additionally, there are various devices which provide a heat output within a very short time, such as less than 10 seconds, after a demand for heat is initiated. Such devices generally utilize spark ignition. It is desirable to provide an electrical resistance igniter having a sufficiently short warm-up time to enable such as igniter to be used in lieu of spark ignition in such devices.

It has been determined that a warm-up time shorter than that in the prior art systems is attainable with an electrical resistance igniter constructed of a tungsten heater element embedded in a silicon nitride insulator. While such an igniter, hereinafter referred to as a silicon nitride igniter, appears to possess the inherent capability of providing the desired feature of a fast warm-up time, it has certain characteristics which necessitate the use of unique control system circuitry.

Specifically, the silicon nitride igniter has a relatively narrow useable temperature range. That is to say, the temperature span between the lowest ignition temperature which will effect ignition and the highest temperature which the igniter can safely and reliably withstand is relatively narrow. If the igniter is repeatedly energized so that its temperature is at or near such a highest temperature, the igniter will eventually fail, such failure generally consisting of melting of the tungsten heater element.

SUMMARY OF THE INVENTION

It is, therefore, a primary object of the invention to provide a generally new and improved fuel burner control system of the type which utilizes an electrical resistance igniter, wherein control means are provided to ensure that the igniter will be operated below its maximum allowable temperature value.

It is a further object to provide such a system wherein the control means is effective to adaptively energize the igniter so as to establish a desired temperature of the igniter, which desired temperature is preferably at or slightly above the lowest possible ignition temperature.

It is a further object to provide such a system wherein the igniter is rapidly heated to attain ignition temperature and is subsequently modulated to maintain ignition temperature.

In the preferrd embodiment, a silicon nitride igniter is connected through solid-state switching means across a power source. A microcomputer and related circuitry control the switching means in such a manner so that the igniter is rapidly heated to ignition temperature during a warm-up time period, and is then modulated to maintain ignition temperature. During each attempt at ignition, the length of the warm-up time period and the degree of modulation are determined by the microcomputer based on sensed values of the voltage across the igniter and on a learning routine so that, after a sufficient number of ignition attempts, the igniter will be energized to a temperature at or slightly above the lowest possible ignition temperature.

The system of the present invention includes various other features, such as checking of various circuit components and controlling of the circulator blower in response to burner flame, which enhance the safety and performance of the system.

The above mentioned and other objects and features of the present invention will become apparent from the following description when read in conjunction with the accompanying drawings.

DESCRIPTION OF THE PREFERRED EMBODIMENT

Figure 1A:
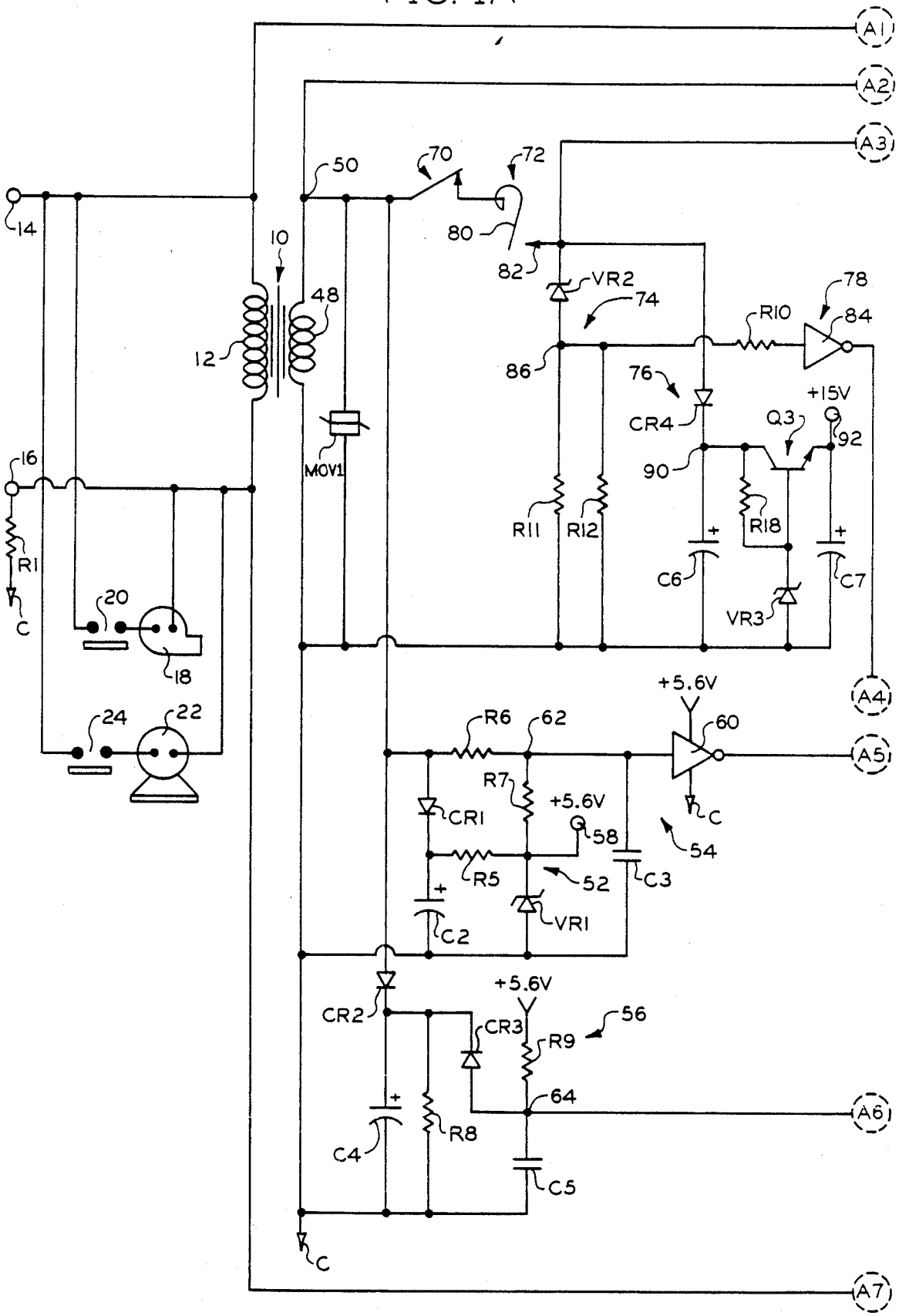
FIGS. 1A, 1B, and 1C, when combined, is a diagrammatic illustration of a burner control system constructed in accordance with the present invention.
Figure 1B:
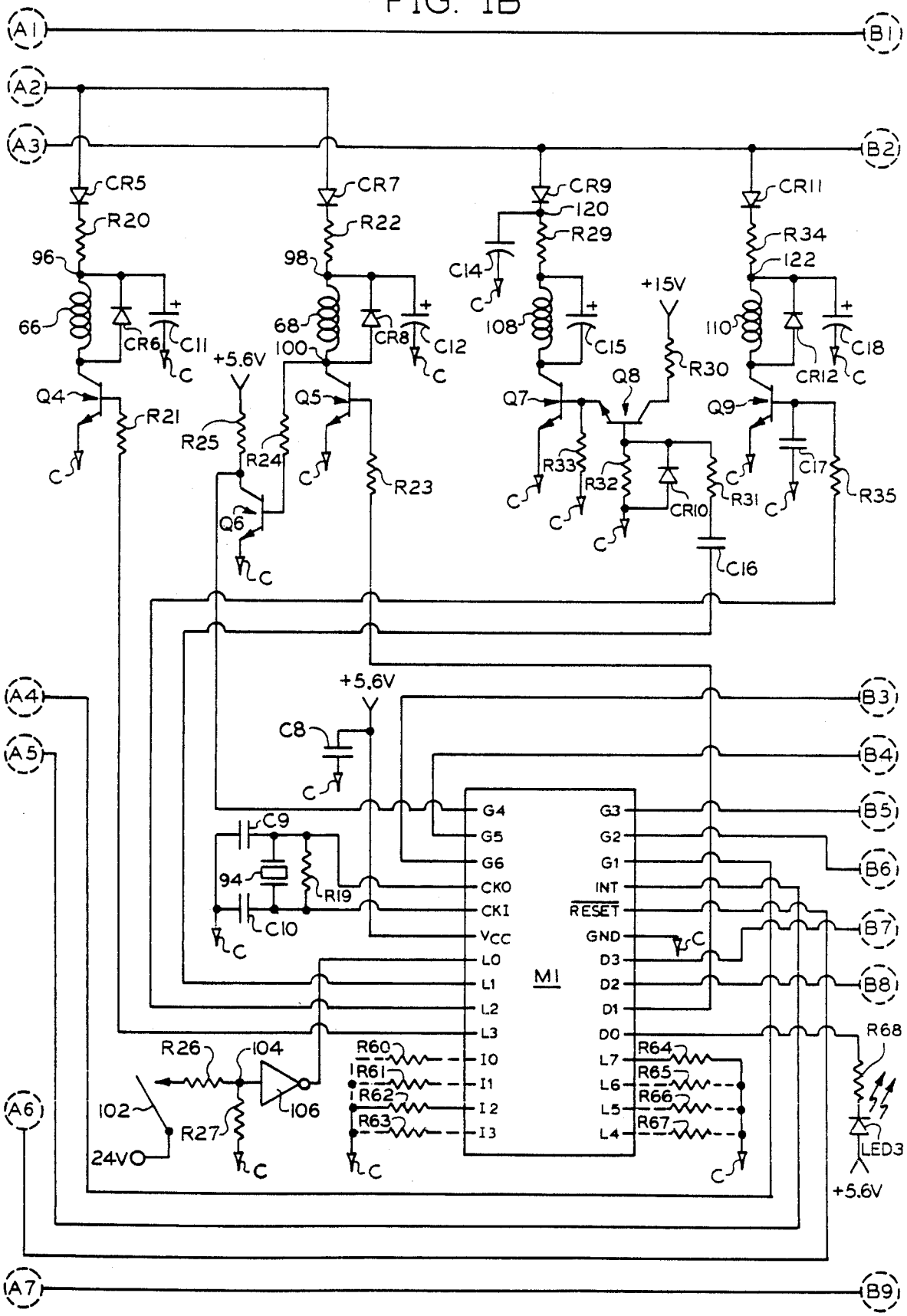
Figure 1C:
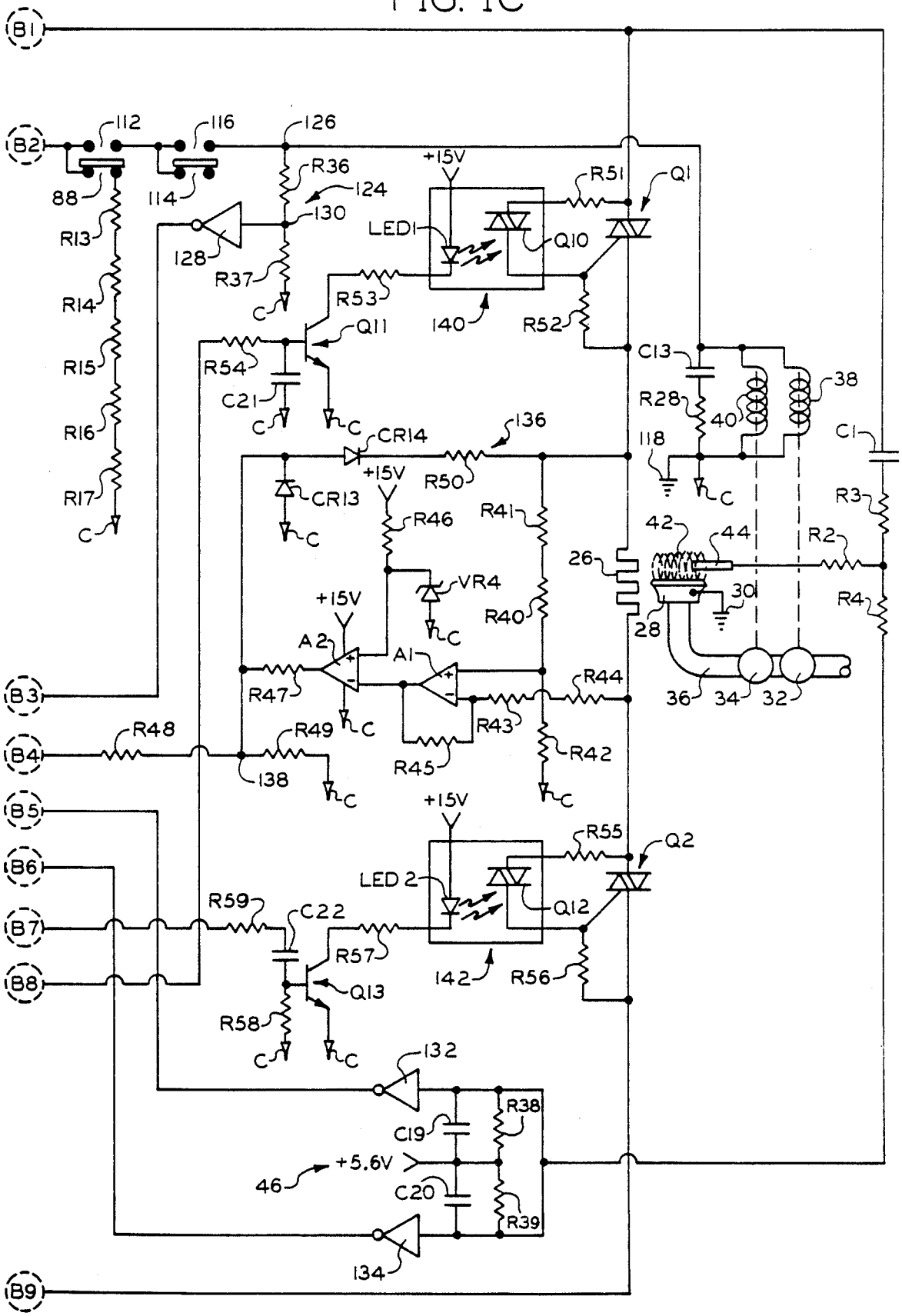

The diagrammatic illustratio of the burner control system of the present invention is obtained by placing FIG. 1A to the left of FIG. 1B and FIG. 1C to the right of FIG. 1B. When so combined, the connecting points A1 through A7 of FIG. 1A are aligned with points A1 through A7 of FIG. 1B, and points B1 through B9 of FIG. 1B are aligned with points B1 through B9 of FIG. 1C.

While the preferred embodiment of the control system utilizes gas as the fuel, it is to be understood that, with minor circuit modifications, other fuels, such as oil, could be used.

Referring to FIG. 1A, the control system of the present invention includes a voltage step-down transformer 10 having a primary winding 12 connected to terminals 14 and 16 of a conventional 120 volt alternating current power source. Terminal 16 is connected through a resistor R1 to chassis common C, hereinafter referred to as common C.

An inducer 18, sometimes also referred to as a purge fan or a combustion air blower, is connected through a set of normally-open relay contacts 20 to terminals 14 and 16. Inducer 18 is in air-flow communication with the combustion chamber of a furnace (not shown). When has is flowing into the combustion chamber, inducer 18 provides the air required for developing a combustible air-gas mixture and provides a positive means for forcing the products of combustion out of the combustion chamber through the flue. It is noted that operation of inducer 18 is required whenever there is a flame so as to prevent the flame from seeking air of combustion from an area outside the combustion chamber. Such a condition would either cause the flame to extinguish or to roll out of the combustion chamber. Also, immediately before and after burner operation, when gas is not flowing, or at various other times as will be hereinafter described, inducer 18 is energizable to purge the combustion chamber of any accumulated unburned fuel or products of combustion. The utilization of inducer 18 is required for these direct ignition burner control systems in which the combustion chamber is sealed. It is to be underdstood, however, that there are other systems in which an inducer is not required and can thus be omitted.

A circulating blower 22 is connected through a set of normally-open relay contacts 24 to terminals 14 and 16. Circulating blower 22 provides for the circulation or distribution of the conditioned air through the dwelling.

Referring to FIG. 1C, an electrical resistance igniter 26 is connected through a triac Q1 to terminal 14 and through a triac Q2 to terminal 16. Igniter 26, which is preferably a silicon nitride igniter, is positioned adjacent a main burner 28 and is effective, when sufficiently heated, to ignite gas emitted from burner 28. Burner 28 is grounded at 30.

The flow of gas to burner 28 is controlled by two valves 32 and 34 connected fluidically in series in a gas conduit 36 leading from a gas source (not shown) to burner 28. A valve winding 38 controls valve 32, and a valve winding 40, connected in parallel with valve winding 38, controls valve 34. Both valves 32 and 34 must be open to enable gas to flow to burner 28 so as to establish a burner flame 42. It is to be understood that valves 32 and 34 can be separate devices as shown or a unitary device. Utilization of such a redundant valve arrangement, wherein two serially-connected valves control the flow of gas to a burner, is well known in the art.

A flame probe 44 is positioned so as to be impinged by burner flame 42. Flame probe 44 is connetced through a resistor R2, a resistor R3, and a capacitor C1 to terminal 14, and through resistor R2 and a resistor R4 to a flame detect circuit indicated generally at 46.

Referring to FIG. 1A, one end of secondary winding 48 of transformer 10 is connected to a junction 50, and the other end thereof is connected to common C so as to provide a 24 volt alternating current power source between junction 50 and common C. A metal oxide varistor MOV1 is connected across secondary winding 48 to suppress any transient voltages.

Also connected across secondary winding 48 are a power supply 52, a real time base circuit 54, and a reset circuit 56.

Power supply 52 includes a rectifier CR1, a filter capacitor C2, a resistor R5, and a zener diode VR1. Rectifier CR1 and capacitor C2 are connected in series, and resistor R5 and zener diode VR1 are connected in series across capacitor C2 so as to provide a +5.6 volt undirectional power source at a terminal 58. This +5.6 volt power source is applied to various circuit components including the microcomputer M1 shown in FIG. 1B. Capacitor C2 is effective, in the event of an electrical power interruption, to maintain the +5.6 volt power source for approximately 5 seconds.

Real time base circuit 54 includes a resistor R6, a resistor R7, a filter capacitor C3, and an inverter 60. The values of resistors R6 and R7 are such that when the AC sine wave of the voltage across secondary winding 48 is at its zero crossover, the voltage at the junction 62 between resistors R6 and R7, which is also the voltage on the input of inverter 60, is at its mid-supply value which value causes inverter 60 to change its output state. The output signal of inverter 60 is therefore a square wave wherein the transitions between the high and low values of the square wave output occur at the zero crossover point of the voltage across secondary winding 48, and the frequency of the square wave is the same as the frequency of the voltage across secondary winding 48, such frequency being 60 Hz in the preferred embodiment. Real time base circuit 54 therefore provides an accurate time base to microcomputer M1 so as to enable microcomputer M1 to provide various critical timed functions which will hereinafter be described. Also, because of the above-described zero crossover feature, microcomputer M1 can execute functions at specific desired times in the sine wave of the voltage across secondary winding 48. As will hereinafter be described, some such functions are programmed to occur at or near the zero crossover point of the sine wave voltage and others are programmed to occur when the sine wave voltage is at its peak value.

Reset circuit 56 includes a rectifier CR2 and a capacitor C4 connected in series across secondary winding 48, a resistor R8 connected in parallel with capacitor C4, a series-connected rectifier CR3 and a capacitor C5 connected in parallel with capacitor C4, and a resistor R9 connected between the +5.6 volt power source and junction 64 between rectifier CR3 and capacitor C5. Prior to electrical power being applied to the system, capacitors C4 and C5 are discharged. When power is applied, capacitor C4 is charged through rectifier CR2 and the peak voltage of the voltage across secondary winding 48. Concurrently, power supply 52 establishes the +5.6 volt power source. When capacitor C4 is sufficiently charged, conduction through rectifier CR3 is blocked, enabling capacitor C5 to be charged by the +5.6 volt power source through resistor R9. When capacitor C5 is charged, the voltage at junction 64 provides a high signal to microcomputer M1, which high signal forces microcomputer M1 out of its reset mode into its run mode. In the event that electrical power is interrupted, capacitor C4 discharges through resistor R8. When capacitor C4 is sufficiently discharged, rectifier CR3 conducts, enabling capacitor C5 to discharge through rectifier CR3 thereby causing the signal at junction 64 to become low, which low signal causes microcomputer M1 to enter its reset mode. The discharge time constant of the capacitor C4 and resistor R8 circuit loop is such that rectifier CR3 is held non-conductive for a short period of time, such as 5 seconds, during which the +5.6 volt power source is still established, and is subsequently rendered conductive before the +5.6 volt power source drops significantly. This manner of operation thus prevents a reset due to a momentary power interruption and yet ensures that reset will occur before microcomputer M1 might cause erroneous system operation due to a decrease of the +5.6 volt power source to a marginal value.

Also connected across secondary winding 48, as shown in FIG. 1B, are a relay coil 66 for controlling relay contacts 24 and a relay coil 68 for controlling relay contacts 20.

Also connected across secondary winding 48 through a high-temperature limit device 70 and a room thermostat 72 are a voltage limiting circuit 74, a power supply 76, and a thermostat input circuit 78. Limit device 70 comprises a normally-closed switch controlled by a temperature sensing element located in the plenum of the furnace. Limit device 70 is effective to open its switch if the temperature in the plenum reaches a value beyond which the furnace is not designed to operate safely. Room thermostat 72 can be any conventional thermostat, either mechanical or electronic. A mechanical type is illustrated in FIG. 1A, wherein a bimetal 80 cooperates with a contact 82 in a well known manner.

Thermostat input circuit 78 includes an inverter 84 whose input is connected through a resistor R10 to a junction 86 between a zener diode VR2 and parallel-connected resistors R11 and R12. Thermostat input circuit 78 functions to provide an input signal to microcomputer M1 indicative of whether or not thermostat 72 is calling for heat. Specifically, when thermostat 72 is not calling for heat, there is no voltage applied to the input of inverter 84. Therefore, the output of inverter 84 is high. When thermostat 72 is calling for heat, zener diode VR2 breaks over when the voltage across secondary winding 48 reaches the required breakover voltage, causing a high to appear on the input of inverter 84. On the reverse polarity of the voltage across secondary winding 48, the input to inverter 84 goes low. Thus, when thermostat 72 is calling for heat, the output signal of inverter 84 is a square wave; when thermostat 72 is not calling for heat, the output signal of inverter 84 is a constant high.

Voltage limting circuit 74 enables the system of the present invention to be used with thermostats which require power at all times. Specifically, in some electronic type thermostats, a small amount of current must be provided to the thermostat during the off-cycle of the thermostat. In the present system, resistors R13 through R17, referring to FIG. 1C, are connected in series through a set of normally-closed contacts 88. When such an electronic type thermostat is used and it is not calling for heat, the amount of current flow through the thermostat and resistors R13 through R17 is such that the voltage across resistors R13 through R17, which is also the voltage across zener diode VR2, is below the breakover value of zener diode VR2. Thus zener diode VR2 does not break over and thermostat input circuit 78 does not falsely produce the square-wave signal indicative of a call for heat.

Power supply 76 includes a rectifier CR4, filter capacitors C6 and C7, a bias resistor R18, a zener diode VR3, and an NPN transistor Q3. Rectifier CR4 and capacitor C6 are connected in series. The collector of transistor Q3 is connected to the junction 90 of rectifier CR4 and capacitor C6. The emiter of transistor Q3 is connected to a terminal 92. Resistor R18 is connected between the base and collector of transistor Q3. Zener diode VR3 is connected between the base of transistor Q3 and common C. Capacitor C7 is connected between terminal 92 and common C. When the contacts of limit device 70 and thermostat 72 are in their closed positions, power supply 76 is effective to provide a +15 volt unidirectional power source at terminal 92. This +15 volt power source is applied to various circuit components in FIGS. 1B and 1C as will hereinafter be described.

Referring to FIG. 1B, microcomputer M1 is a single componenet 8-bit device. Included within microcomputer M1 are an 8-bit CPU (central processing unit), a 4K×8 ROM (read only memory), a 128×8 RAM (random access read/write memory), 23 I/O (input/output) lines, a clock, and a 16-bit timer/event counter. The pins of microcomputer M1 are designated $V_{CC}$, CK0, CKI, INT, GND, $\overline{\text{RESET}}$, D0 through D3, G1 through G6, I0 through I3, and L0 through L7.

Pin $V_{CC}$ of microcomputer M1 is connected to the +5.6 volt power source and functions as the main power supply input to microcomputer M1. A filter capacitor C8 is connected between pin $V_{CC}$ and common C. Pin GND is connected to common C and functions as the connected of microcomputer M1 to common C potential.

An external oscillator comprises a ceramic resonator 94 in the form of a quartz crystal connected between pins CK0 and CKI, a resistor R19 connected across resonator 94, a capacitor C9 connected between pin CK0 and common C, and a capacitor C10 connected between pin CKI and common C. This oscillator construction provides a machine cycle time of approximately 2.8 microseconds.

The $\overline{\text{RESET}}$ pin is connected to junction 64 in reset circuit 56. The INT pin is connected to the output of inverter 60 of the real time base circuit 54. Pin G1 is connected to the output of inverter 84 of thermostat input circuit 78. (It is to be noted that, for brevity, the various ports and bits are being referred to as pins. For example, port G, bit 1, is referred to as pin G1.)

Relay coil 66 is connected across secondary winding 48 through a rectifier CR5, a resistor R20, and an NPN resistor Q4. The base of transistor Q4 is connected through a resistor R21 to pin L3 of microcomputer M1. A rectifier CR6 is connected in parallel with relay coil 66 to suppress and back EMF generated by relay winding 66, thereby protecting transistor Q4 from any high voltage or high current due to such EMF generation. A capacitor C11 is connected between common C and junction 96 of relay coil 66 and resistor R20. Capacitor C11 charges to the peak voltage of the 24 volt power source at secondary winding 48 so as to assist in initial energizing of relay coil 66, and also functions as a filter when rectifier CR5 is blocking current flow. When energizing of relay coil 66 is desired, microcomputer M1 provides a constant digital high signal at pin L3, which high signal biases on transistor Q4. With transistor Q4 on, relay coil 66 is energized and effects closing of its contacts 24. When contacts 24 closed, circulator blower 22 is energized. When energizing of relay coil 66 is not desired, microcomputer M1 causes pin L3 to remain low.

Similarly, relay coil 68 is connected across secondary winding 48 through a rectifier CR7, a resistor R22, and an NPN transistor Q5. The base of transistor Q5 is connected through a resistor R23 to pin D1 of microcomputer M1. A rectifier CR8 is connected across relay coil 68, and a capacitor C12 is connected between common C and the junction 98 of relay coil 68 and resistor R22 to perform the same functions for relay coil 68 as performed by rectifier CR6 and capacitor C11 for relay coil 66. When energizing of relay coil 68 is desired, microcomputer M1 provides a constant digital high signal at pin D1, which high signal biases on transistor Q5. With transistor Q5 on, relay coil 68 is energized and effects closing of its contacts 20. With contacts 20 closed, inducer 18 is energized. When energizing of relay coil 68 is not desired, microcomputer M1 causes pin D1 to remain low.

The base of an NPN transistor Q6 is connected through a resistor R24 to the junction 100 of relay coil 68 and transistor Q5. The emitter of transistor Q6 is connected to common C. The collector of transistor Q6 is connected through a resistor R25 to the +5.6 volt power source and to pin G4 of microcomputer M1. This circuit provides for checking proper operation of transistor Q5. Specifically, the program logic in microcomputer M1 provides for monitoring of pin G4. When transistor Q5 is off due to a low signal at pin D1, transistor Q6 is biased on so that the input signal to pin G4 is low; when transistor Q5 is biased on due to a high signal at pin D1, transistor Q6 is off so that the input signal to pin G4 is high. If the input signals to pin G4 are not as they are supposed to be, the system enters lockout, a condition to be hereinafter described.

Generally, when inducer 18 is utilized, a pressure switch, responsive to the movement of air by inducer 18, is provided. Accordingly, a pressure switch 102 is connected through resistors R26 and R27 across the 24 volt power source provided by secondary winding 48. The junction 104 of resistors R26 and R27 is connected to the input of an inverter 106. The output of inverter 106 is connected to pin L0 of microcomputer M1. In operation, when pressure switch 102 is open, the input of inverter 106 is low whereby the output thereof is high. When pressure switch 102 is closed, the input of inverter 106 is alternately high and low, due to the 60 Hz supply, whereby the output thereof is a 60 Hz square wave signal. If the input signals to pin L0 are not as they are suppose to be, the system enters lockout.

A pair of relay coils 108 and 110 are connected in parallel with each other across secondary winding 48 through limit device 70 and thermostat 72. Relay coil 108 contraols the set of normally-closed relay contacts 88 and a set of normally-open relay contacts 112, shown in FIG. 1C, and relay coil 110 controls a set of normally-closed relay contacts 114 and a set of normally-open relay contacts 116. When gas flow to burner 28 is desired, relay coils 108 and 110 are energized, causing their normally-open contacts 112 and 116 to close. With contacts 112 and 116 closed, valve windings 38 and 40 are energized, causing valves 32 and 34, respectively, to open. A filter capacitor C13 and a resistor R28 are connected in series across valve windings 38 and 40. One end of resistor R28, one end of valve winding 38, and one end of valve winding 40 are connected to common C which is grounded at 118.

Relay coil 108 is connected in series with a rectifier CR9, a resistor R29 and an NPN transistor Q7. A filter capacitor C14 is connected between common C and the junction 120 of rectifier CR9 and resistor R29. A capacitor C15 is connected in parallel with relay coil 108. The base of transistor Q7 is connected through the enitter-collector circuit of an NPN transistor Q8 and a resistor R30 to the +15 volt power source. The base of transistor Q8 is connected through a resistor R31 and a capacitor C16 to pin L1 of microcomputer M1. A rectifier CR10 is connected between the base of transistor Q8 and common C. A resistor R32 is connected between the base of transistor Q8 and common C, and a resistor R33 is connected between the base of transistor Q7 and common C. Resistors R32 and R33 provide a path for any leakage current from transistors Q8 and Q7, respectively, to common C.

When energizing of relay coil 108 is desired, microcomputer M1 provides a high frequency digital signal, 1K Hz in the preferred embodiment, at pin L1. The high portion of the signal passes through capacitor C16, resistor R31, the base-emitter circuit of transistor Q8 and the base-emitter circuit of transistor Q7, turning on transistors Q8 and Q7. With transistor Q8 on, the +15 volt power source provides additional bias current to transistor Q7. With transistor Q7 on, relay coil 108 is energized, causing its normally-open contacts 112 to close, and capacitor C15 charges through resistor R29. During the low portion of the signal, capacitor C16 discharges through rectifier CR10 and resistor R31, causing transistors Q8 and Q7 to turn off. With transistor Q7 off, capacitor C15 discharges through relay coil 108 as as to keep relay coil 108 energized until transistor Q7 is again turned on. The charging and discharging time constants of capacitor C15 are such that transistor Q7 must be operated at a frequency considerably greater than 60 Hz to effect energizing of relay coil 108. Specifically, when transistor Q7 is biased on, capacitor C15 is charged, but only partially. It requires a number of on-off cycles of transistor Q7 to effect full charging of capacitor C15. Such a partial charge is sufficient to maintain relay coil 108 energized on discharge of capacitor C15 when the off time of transistor Q7 is very short, as it is when the signal is considerably greater than 60 Hz. However, if the signal were, for example, 60 Hz, the off time of transistor Q7 would be too long, allowing capacitor C15 to discharge to a voltage level no longer capable of maintaining energizing of relay coil 108.

The 1K Hz signal is preferably applied only during a small portion of the time during which relay coil 108 is energized. This small portion of time is the ignition activation period (IAP) during which igniter 26 is energized and gas is flowing to burner 28. After the IAP, the signal is changed to a lower frequency signal, such as 250 Hz, which still ensures continued energizing of relay coil 108 but effects a desired reduction in the effective voltage across relay coil 108. Such a reduced voltage across relay coil 108 prevents overheating of relay coil 108.

When energizing of relay coil 108 is not desired, microcomputer M1 provides a constant low at pin L1. When the signal at pin L1 is low, transistors Q8 and Q7 are off.

Relay coil 110 is connected in series with a rectifier CR11, a resistor R34, and an NPN transistor Q9. The base of transistor Q9 is connected through a resistor R35 to pin L2 of microcomputer M1. A capacitor C17 is connected between the base of transistor Q9 and common C to filter out any high frequency signals, such as signals at the frequency of ceramic resonator 94, which may, due to a fault condition, appear at pin L2. A rectifier CR12 is connected across relay coil 110, and a capacitor C18 is connected between common C and the junction 122 of relay coil 110 and resistor R34 to perform the same functions for relay coil 110 as performed by rectifier CR6 and capacitor C11 for relay coil 66.

When energizing of relay coil 110 is desired, microcomputer M1 provides a constant digital high signal at pin L2, which high signal biases on transistor Q9. With transistor Q9 on, relay coil 110 is energized and effects closing of its normally-open contacts 116. When energizing of relay coil 110 is not desired, microcomputer M1 causes pin L2 to remain low.

It is believed to be a significant safety feature that transistor Q7 requieres a high frequency digital signal and transistor Q9 requires a constant digital high signal to enable them to be conductive. It is believed extremely unlikely that any malfunction of microcomputer M1 could cause such diverse signals to develop at different bits (1 and 2) of single port (L).

The provision of two sets of normally-open relay contacts 112 and 116, connected in series, provides a desired redundancy in controlling operation of valves 32 and 34. To ensure the existence of such redundancy, relay contacts 112 and 116 are checked during each burner cycle. To enable such checking, a relay contact checking circuit 124, illustrated in FIG. 1C, is provided.

Circuit 124 includes resistors R36 and R37 connected in series between common C and the junction 126 of relay contacts 116 and valve windings 38 and 40, and an inverter 128 having its input connected to the junction 130 of resistors R36 and R37 and its output connected to pin G6 of microcomputer M1. In a program for checking relay contacts 112 and 116, microcomputer M1 provides the 1K Hz signal at pin L1, which signal causes relay coil 108 to be energized. With relay coil 108 energized, its controlled contacts 112 close. Concurrently, the signal at pin L2 of microcomputer M1 is kept low so thay relay coil 110 remains de-energized. With relay coil 110 de-energized, its controlled contacts 116 remain open. With contacts 112 closed and contacts 116 open, the input of inverter 128 is low so that its output is high. Microcomputer M1 checks the signal at pin G6 at the voltage peaks of the voltage across secondary winding 48. A high signal at pin G6 indicates that contacts 116 are open, as they should be. If contacts 116 were erroneously closed, for example, due to being welded together, the input of inverter 128 would be high so that its output would be low. A low signal at pin G6 would be detected, causing microcomputer M1 to effect system lockout. Microcomputer M1 then provides the constant digital high signal at pin L2, which signals causes relay coil 110 to be energized, thus causing contacts 116 to close. Concurrently, microcomputer M1 provides a constant digital high signal at pin L1, which signal is blocked by capacitor C16, thus providing a check of capacitor C16. With no signal being applied to transistors Q8 and Q7, relay coil 108 is de-energized, thus causing contacts 112 to open. Microcomputer M1 checks the signal at pin G6. A high signal at pin G6 indicates that contacts 112 are open, as they should be. A low signal would indicate that contacts 112 were erroneously closed. Again, a low signal would cause microcomputer M1 to effect system lockout.

Since a high signal at pin G6 could also be due to a fault in relay contact checking circuit 124, such fault being, for example, a shorted resistor R37 which would place the input of inverter 128 at common C potential, there is also a program for checking the integrity of checking circuit 124. Specifically, when both sets of relay contacts 112 and 116 close to initiate energizing of valve windings 38 and 40, microcomputer M1 checks the signal at pin G6. Under this condition, the signal at pin G6 must be a digital square wave. If the signal is not a square wave, either one or both of the sets of relay contacts 112 and 116 are open or checking circuit 124 is defective; in either case, the system enters lockout.

Referring to FIG. 1C, flame detect circuit 46 includes a capacitor C19 and a resistor R38 connected in parallel between the +5.6 volt power source and the input of an inverter 132, and a capacitor C20 and a resistor R39 connected in parallel between the +5.6 volt power source and the input of an inverter 134. The outputs of inverters 132 and 134 are connected to pins G3 and G2, respectively, of microcomputer M1. The inputs of inverters 132 and 134 are connected to resistor R4.

In reference to inverter 132, when burner flame 42 is absent, capacitor C19 is alternately charged and discharged by the 120 volt power source and the +5.6 volt power source through capacitor C1 and resistor R1, R3, and R4. The values of resistors R1, R2, and R3 and capacitor C19 are such that the net charge on capacitor C19 changes very little whereby the input of inverter 132 remains essentially at the +5.6 volt power source potential. With the input of inverter 132 high, the output thereof is low. When burner flame 42 is present, current flows through the burner flame 42. Due to the flame rectification, a well known principle, more current flows through burner flame 42 on one polarity of the 120 volt power source voltage than on the reverse polarity. Specifically, during the half-cycle when the greater value of current flows, the circuit through resistor R2, flame probe 44, burner flame 42, and burner 28 to ground 30, acts as a shunt, reducing the charging of capacitor C19 to a value less than is effected when burner flame 42 is absent. When the polarity of the 120 volt power source reverses, the +5.6 volt power source is effective to charge capacitor C19 so that the net charge on capacitor C19 causes the input of inverter 132 to be low. With the input of inverter 132 low, the output thereof is high. Invertor 134 functions in the same manner.

Thus, when burnere flame 42 is absent, the outputs of inverters 132 and 134 are low; when burner flame 42 is present, the outputs are high. Microcomputer M1 is programmed to monitor pins G3 and G2 so as to determine whether burner flame 42 is absent or present, and to provide for various system functions, as will hereinafter be described, in response to such monitoring. It is to be noted that microcomputer M1 is programmed to require that the signal on pins G3 and G2 must always be the same, that is, both pins G3 and G2 must be high or both must be low. If the signals are not the same, the system enters lockout. This redundancy enhances the safety of the system.

Referring to FIG. 1C, it is required that igniter 26 be capable of igniting the air-gas mixture when the applied 120 volt alternating current power source voltage, hereinafter referred to as line voltage, is as low as 97 volts or as high as 132 volts.

A particular characteristic of silicon nitride igniter 26 is that if the temperature of igniter 26 is high enough to ignite the air-gas mixture with a line voltage of 97 volts across it, the temperature would exceed an allowable maximum value at an applied line voltage of 132 volts. Specifically, it has been determined that a temperature of approximately 2000° F. must be attained by igniter 26 to reliably ignite the air-gas mixture. If this temperature is attained with an applied line voltage of 97 volts, the temperature of igniter 26 at 132 volts would be excess of 2400° F., which is the maximum temperature igniter 26 can withstand. At temperature higher than 2400° F., the tungsten heater element in igniter 26 begins to melt, causing igniter failure.

It has been determined that igniter 26 can be safely and reliably operated when the temperature of igniter 26 is below approximately 2325° F. It has also been determined that, due to manufacturing tolerances, the temperature variation from one igniter to another in a production lot can be approximately 300° F. Thus, if igniter 26 is designed for operation at 2175° F., the midpoint of the temperature tolerance span, the maximum temperature of igniter 26 would be 2325° F. and the lowest temperature would be 2025° F., which lowest temperature is still high enough to ignite gas.

Igniter 26 is so constructed that an applied voltage of 80 volts to igniter 26 will enable igniter 26 to attain and/or maintain a temperature of approximately 2175° F. (The tolerance on the temperature is 2000° F. to 2325° F. as stated above.) To provide a constant 80 volt source to igniter 26, use is made of the known formula $V=\sqrt{E^2\times N\times 1/f}$, wherein V=desired voltage (RMS) across igniter 26; E=available voltage (RMS) to igniter 26, N=number of line voltage cycles that igniter 26 is to be on during a one-second period; and f=line frequency. As will hereinafter be described, circuit means are provided to measure the voltage available to igniter 26 and determine, in accordance with the formula, the number of line voltage cycles required to provide a constant 80 volt source to igniter 26.

While an applied voltage of 80 volts of igniter 26 will enable it to attain ignition temperature, it is preferable that a higher voltage be initially applied so as to cause a rapid initial heating of igniter 26 to ignition temperature, and then the voltage be reduced to maintain the ignition temperature. Specifically, the system provides for applying full line voltage to igniter 26 for a short period of time, hereinafter referred to as warm-up time, which time is dependent upon the value of the measured voltage across igniter 26 and which has been determined to be of such duration that, at the end of such time, igniter 26 will be at the desired ignition temperature. Thereafter, igniter 26 is energized only during a portion of the line voltage cycles, in accordance with the formula, so as to reduce the effective voltage across igniter 26 to a value adequate to maintain ignition temperature.

However, in addition to being dependent upon the value of the applied voltage, the temperature of igniter 26 is also dependent upon other factors. Such factors include environmental conditions such as the cooling effect caused by the flow of air or air-gas mixture past the igniter 26, and various characteristics of igniter 26, which characteristics vary due to manufacturing tolerances. Accordingly, as will hereinafter be described, the system of the present invention includes means for adjusting the length of the warm-up time period and the determined number of line voltage cycles that igniter 26 is on during a 1 second period, sometimes referred to as the duty cycle or degree of modulation, so as to compensate for such factors, and by so compensating, to establish the lowest possible operating temperature of igniter 26 and thereafter operate igniter at a desired temperature above the lowest possible operating temperature and well below the maximum allowable temperature so as to increase the effective life of igniter 26.

Referring to FIG. 1C, a voltage sensing circuit is shown generally at 136. Sensing circuit 136 includes a differential amplifier A1 having its non-inverting input pin connected through resistors R40 and R41 to one side of igniter 26 and through a resistor R42 to common C. The inverting input pin is connected through resistors R43 and R44 to the other side of igniter 26 and through a feedback resistor R45 to the output of amplifier A1. The output of amplifier A1 is connected to the inverting input pin of a comparator A2. The non-inverting input pin of comparator A2 is connected through a resistor R46 to the +15 volt power source. A zener diode VR4 is connected between the non-inverting input pin and common C to provide a constant voltage +4.7 volts on the non-inverting input pin. The output of comparator A2 is connected through a resistor R47 to a junction 138 of resistors R48 and R49. Resistor R48 is connected between junction 138 and pin G5 of microcomputer M1. Resistor R49 is connected between junction 138 and common C. A rectifier CR13 is connected between junctions 138 and common C. A rectifier CR14 and a resistor R50 are connected in series between junction 138 and one side of igniter 26.

A function of sensing circuit 136 is to provide to microcomputer M1 a parameter indicative of the value of the voltage applied across igniter 26. When triacs Q1 and Q2 are conducting and the like voltage is in the half-cycle in which terminal 14 is positive with respect to terminal 16, the output of amplifier A1 becomes increasingly more positive as the sinusoidal line voltage increases from zero toward its maximum value. The values of resistors R40 through R45 are such that when the instantaneous value of the voltage across igniter 26 becomes greater than 115 volts, the output of amplifier A1 becomes sufficiently higher than +4.7 volts so as to cause the output of comparator A2 to become low. This low signal is detected at pin G5 of microcomputer M1. The output of comparator A2 remains low until the instantaneous value of the voltage across igniter 26 decreases to a value less than 115 volts, at which time the output of amplifier A1 becomes sufficiently less than +4.7 volts so as to cause the output of comparator A2 to become high. This high signal is detected at pin G5 of microcomputer M1. Resistors R47 and R49 function as a voltage divider to insure that the +15 volt output of comparator A2 will be reduced to +5.6 volts at junction 138 so as to provide a desirable value of the high signal to pin G5.

In response to the time at which pin G5 goes low and the time at which pin G5 goes high, microcomputer M1 determines the duty cycle or degree of modulation, that is, the number of line voltage cycles that igniter 26 must be on during a one-second period. For example, suppose the above-described times sensed by pin G5 define that the available voltage (E) to igniter 26 is 118 volts. If the frequency (f) is 60 Hz and the desired voltage across igniter 26 (V) is 80 volts, the duty cycle (N), in accordance with the formula, $V=\sqrt{E^2\times N\times 1/f}$, should be 28. As will hereinafter be described more fully, microcomputer M1 also determines the length of the warm-up time period based on the value of the duty cycle. In the preferred embodiment, microcomputer M1 determines the duty cycle by utilizing look-up tables in ROM, which tables are consistent with the formula. It is to be understood that microcomputer M1 could alternately determine the duty cycle by calculation.

During the reverse polarity, when the line voltage is in the half-cycle in which terminal 14 is negative with respect to terminal 16, current is pulled from the non-inverting input pin of amplifier A1. When the output of amplifier A1 becomes sufficiently higher than +4.7 volts, the output of comparator A2 goes low so that the signal at pin G5 is low. When the instantaneous value of the voltage across igniter 26 decreases to approximately −20 volts, rectifier CR14 begins to conduct. With rectifier CR14 conducting, rectifier CR13 is biased into conduction, forcing junction 138 to be at approximately 0.6 volts (the voltage drop across rectifier CR13) below the potential of common C, whereby the signal at pin G5 remains low. The signal at pin G5 subsequently goes high when the voltage across igniter 26 increases to approximately −20 volts.

Microcomputer M1 executes the above described determination of the duty cycle for 3 seconds, beginning at the start of the warm-up time period. During the remainder of the warm-up time period, microcomputer M1 checks that triacs Q1 and Q2 are functioning properly and that igniter 26 is connected and/or is not open. To effect such function, microcomputer M1 is programmed to check, during the remainder of the warm-up time period, the status of pin G5 when the instantaneous value of the voltage across igniter 26 is at its maximum value during both the positive and negative half-cycles. In view of the above description of the status of pin G5 during the determination of the duty cycle, it will be apparent that the signal at pin G5 must be low at the positive and negative peak voltage values. If the signal is not low, either one or both of triacs Q1 and Q2 are half-waving or are shorted, or igniter 26 is not connected or is open. If the signal is not low, the system enters lockout.

Triac Q1 is controlled by an opto-triac driver 140 which comprises an LED 1 (light emitting diode) and a triac Q10. One of the main terminals of triac Q10 is connected to one of the main terminals of triac Q1 through a resistor R51. The other main terminal of triac Q10 is connected to the gate terminal of traic Q1 and through a resistor R52 to the other main terminal of triac Q1. The anode of LED 1 is connected to the +15 volt power source. The cathode of LED 1 is connected through a resistor R53 to the collector of an NPN transistor Q11. The emitter of transistor Q11 is connected to common C. The base of transistor Q11 is connected through a resistor R54 to pin D2 of microcomputer M1. A capacitor C21 is connected between the base of transistor Q11 and common C to filter out any high frequency signals, such as signals at the frequency of ceramic resonator 94, which may erroneously appear at pin D2.

When conduction of triac Q1 is desired, microcomputer M1 provides a 120 Hz signal at pin D2 comprising a digital high portion of approximately 833 microseconds and a digital low portion of the remainder of each half-cycle of the 60 Hz line voltage wave-form. The high portion of the 120 Hz signal is initiated at or near the zero crossovers of the line voltage wave-form. When the signal at pin D2 is high, transistor Q11 is biased on, causing LED 1 to be energized. With LED 1 energized, triac Q10 is gated on. With triac Q10 on, triac Q1 is gated on. Once gated on at the beginning of each half-cycle, triac Q1 remains conductive during the remainder of each half-cycle. The brief duration of the on time of transistor Q11 reduces the power drain from the +15 volt power source. When conduction of triac Q1 is not desired, microcomputer M1 holds pin D2 at a constant digital low.

Triac Q2 is controlled by an opto-triac driver 142 which comprises an LED 2 and a triac Q12. One of the main terminals of triac Q12 is connected to one of the main terminals of traic Q2 through a resistor R55. The other main terminal of triac Q12 is connected to the gate terminal of triac Q2 and through a resistor R56 to the other main terminal of triac Q2. The anode of LED 2 is connected to the +15 volt power source. The cathode of LED 2 is connected through a resistor R57 to the collector of an NPN transistor Q13. The emitter of transistor Q13 is connected to common C. The base of transistor Q13 is connected through a resistor R58 to common C, and through a capacitor C22 and a resistor R59 to pin D3 of microcomputer M1.

When conduction of triac Q2 is desired, microcomputer M1 provides, at pin D3, the same 120 Hz signal as previously described for controlling triac Q1. Capacitor C22 is effective to block any constant digital high signal that may erroneously appear at pin D3. When conduction of triac Q2 is not desired, microcomputer M1 holds pin D3 at a constant digital low.

Triacs Q1 and Q2 are checked to determine that they are functioning properly. Not only are they checked during the time that igniter 26 is energized, in the manner previously described, they are also checked prior to energizing of igniter 26.

Specifically, prior to the time at which energizing of igniter 26 is initiated, microcomputer M1 provides the previously described 120 Hz signal at pin D2 to effect conduction of triac Q1. Concurrently, microcomputer M1 provides a constant digital high at pin D3. Pin G5, which is connected to junction 138, is monitored. Since capacitor C22 is initially discharged, a constant digital high at pin D3 will cause transistor Q13 to be biased on, thus effecting conduction of triac Q2. However, after one half-cycle, capacitor C22 will be charged, thus blocking the constant digital high and preventing further conduction of transistor Q13. Because of this check of capacitor C22, monitoring of pin G5 is delayed for at least one half-cycle.

During the half-cycle in which terminal 14 is positive with respect to terminal 16, the output of amplifier A1 remains at common C potential. Under this condition, the output of comparator A2 is high so that pin G5 is high. Pin G5 is checked when the instantaneous value of the line voltage is at its maximum value. During the reverse polarity half-cycle, the current flow through rectifiers CR13 and CR14 and resistor R50 pulls the output of comparator A2 low. However, the current flow is insufficient to hold in triac Q1. With triac Q1 off, the output of comparator A2 becomes high so that pin G5 is again high. It is to be noted that pin G5 is monitored when the instantaneous value of the line voltage is at its maximum negative value so that the momentary low at pin G5 will not be detected. In view of the previously described check of triacs Q1 and Q2 performed when igniter 26 is energized, it should be apparent that a monitored low at pin G5, with triac Q2 biased off, would indicate that triac Q2 is shorted or half-waving. Accordingly, if the signal at pin G5 is low, the system enters lockout.

In a similar manner, microcomputer M1 then checks triac Q1. Specifically, microcomputer M1 provides the previously described 120 Hz signal at pin D3 to effect conduction of triac Q2, and provides a constant digital low at pin D2 to prevent conduction of triac Q1. During both half-cycles of the line voltage, there is no current flow through sensing circuit 136. Under the condition, the output of comparator A2, and thus the signal at pin G5, is a constant high. A monitored low at pin G5, with triac Q1 biased off, would indicate that triac Q1 is shorted of half-waving. If the signal at pin G5 is low, the system enters lockout.

When the line voltage source at terminals 14 and 16 is 120 volts, the use of the two triacs Q1 and Q2 provides redundancy. If the line voltage were 240 volts, triacs Q1 and Q2, by virtue of being connected to opposite sides of igniter 26, provide the desired function of electrically disconnecting igniter 26 from both sides of the 240 volt power source.

A plurality of resistors R60 through R67 are shown in FIG. 1B, some of which are connected to various pins of microcomputer M1 and others of which, as indicated by dashed lines instead of solid lines, are not connected. An internal pull-up resistor is associated with each of the various pins to cause them to be normally high. The connection or non-connection of resistors R60 through R67 is determined by the specific system operation desired.

For example, in the program of microcomputer M1, a post-purge time period of, for example, 5 seconds is provided in the basic program logic. In some systems, a longer post-purge time period of, for example, an additional 15 seconds, is desired. A digital high at pin I0 enables such an additional post-purge timing and a digial low disenables such timing. With resistor R60 connected between pin I0 and common C, pin I0 would be low and the additional post-purge timing would be disenabled. With resistor R60 not connected, pin I0 is high, enabling the additional post-purge timing. Since the preferred embodiment of the present invention utilizes the additional post-purge timing, resistor R60 is shown as not being connected. Therefore, the reason for illustrating non-connected resistor R60 and other non-connected resistors is to describe more fully the versatility of the system of the present invention.

The connection or non-connection of resistor R61 to pin I1 determines whether microcomputer M1 will monitor the inducer pressure switch 102. If resistor R61 were connected, no monitoring would occur; with resistor R61 not connected, as shown in FIG. 1B, monitoring will occur.

The connection or non-connection of resistor R62 to pin I2 establishes a desired value of an initial offset to the initial duty cycle as will hereinafter be described. Resistor R62 is shown as being connected.

The connection or non-connection of resistor R63 to pin I3 determines how the system can exit the lockout condition. With resistor R63 not connected, as shown in FIG. 1B, the system can exit the lockout condition only by disconnecting the system from the power source at terminals 14 and 16 and then re-connecting the system. If resistor R63 were not connected, the lockout condition could be exited, if the contacts of limit device 70 are closed, by opening and then re-closing thermostat 72.

Resistor R64 is connected or not connected to pin L7 to establish even parity with resistors R60 through R63, and R65 through R67. As shown in FIG. 1B, resistor R64 is connected. If parity is wrong, the system enters lockout.

The connection or non-connection of resistor R65 to pin L6 establishes a desired trial for ignition time period. With resistor R65 not connected, as shown in FIG. 1B, the time period is 4 seconds. If resistor R65 were connected, the time period would be 7 seconds.

The connection or non-connection of resistors R66 and R67 to pins L5 and L4, respectively, establishes a desired pre-purge time period. With neither resistor R66 nor R67 connected, as shown in FIG. 1B, the time period is 30 seconds. If only resistor R66 were connected, the time period would be 17 seconds; if only R67 were connected, the time period would be 20 seconds; and if both resistors R66 and R67 were connected, there would be no pre-purge.

Referring to FIG. 1B, the anode of an LED 3 is connected to the +5.6 volt power source, and the cathode thereof is connected through a resistor R68 to pin D0 of microcomputer M1. Microcomputer M1 effects energizing of LED 3 whenever the system is in lockout and effects energizing in such a manner that the cause of the lockout can be generally determined. Specifically, microcomputer M1 causes LED 3 to flash on and off at a visibly detectable rate, such as 1 Hz, should lockout occur as a result of the depletion of the allowable number of recycles or retries. Should lockout occur as a result of various hardware or software failures, microcomputer M1 causes LED 3 to flash on and off in a coded manner and at such a rate that LED 3 appears to be continuously on. Such coded flashing of LED 3 can be read by a diagnostic tool (not shown) so as to determine more specifically the cause of the lockout.

OPERATION

Microcomputer M1 is programmed to provide system operation in a manner illustrated, in simplified form, in the flow chart of FIGS. 2A through 2I.

Figure 2A:
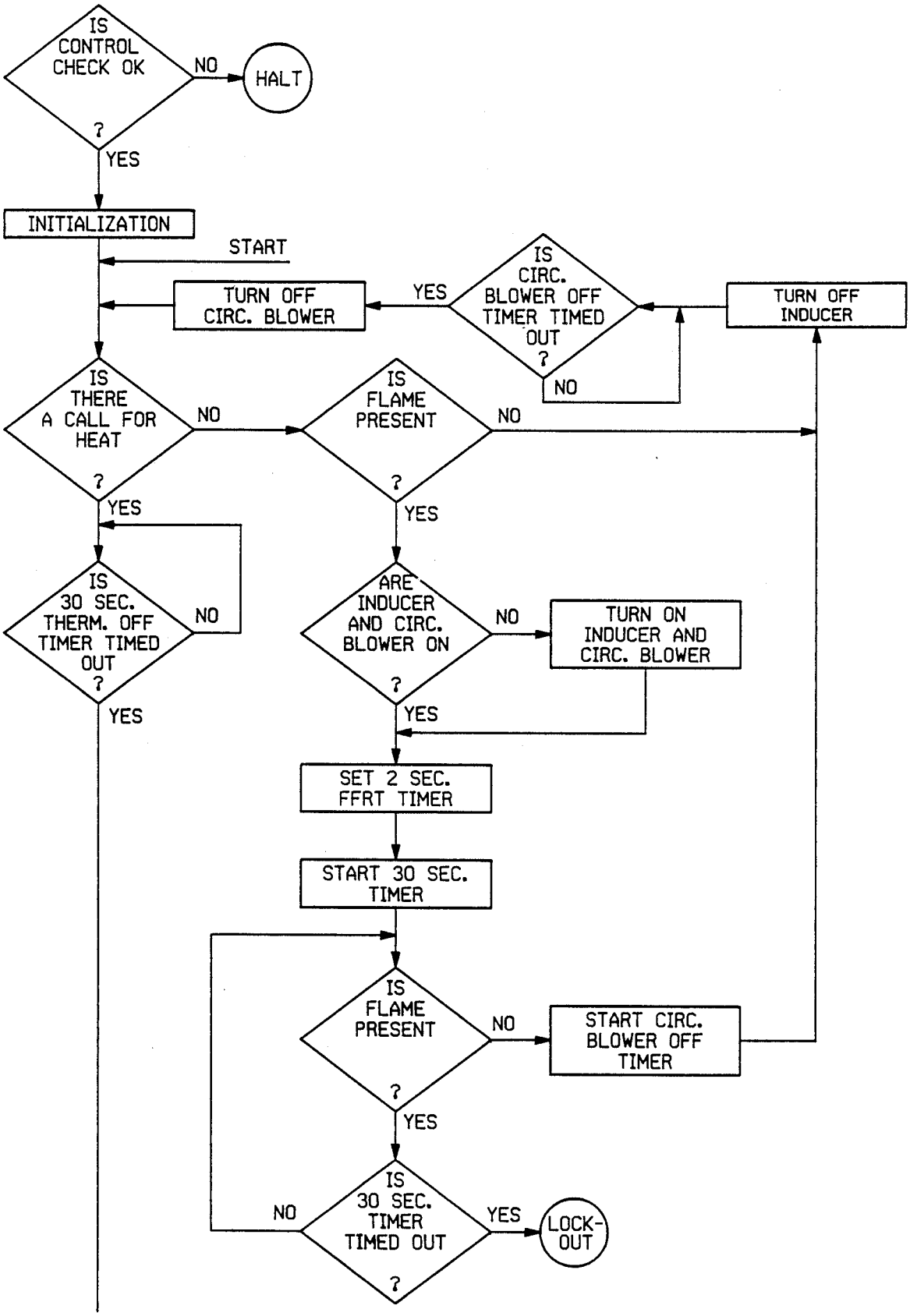
FIGS. 2A through 2I, when combined, is a flow chart depicting the logic sequence programmed into and executed by the microcomputer of the system of combined FIGS. 1A, 1B, and 1C.

Referring to FIG. 2A, when electrical power is applied to the system, microcomputer M1 performs a control check which includes self-checks of ROM and RAM and a check of the CPU. If the check indicates that there is a malfunction in microcomputer M1, the system enters a halt condition wherein further system operation is prevented. If the control check indicates that microcomputer M1 is functioning properly, microcomputer M1 executes initialization which, among other functions, causes all timers to be set to zero, and causes all ports to be in such modes so that all connected devices are de-energized. The program then advances to an inquiry of whether there is a call for heat. This inquiry may be the first such inquiry after initialization or it may be an inquiry subsequent to a previous successful or unsuccessful burner cycle which returned the program to the point in the program illustrated as START.

A call for heat requires that the contacts in both limit device 70 and thermostat 72 be closed. As previously described, when the contacts in both limit device 70 and thermostat 72 ase closed, a call for heat is indicated by the generation of a square wave signal by inverter 84, which square wave signal then appears at pin G1 of microcomputer M1. Thus, if there is no call for heat, the reason for there being no call for heat is that the contacts of either or both limit device 70 and thermostat 72 are open.

If there is no call for heat, the next logic inquiry is whether flame 42 is present. Normally, flame 42 should not be present. If this is the first burner cycle after initialization, flame 42 has not been previously established. If there has been a previous burner cycle, the opening of the contacts of either limit device 70 or thermostat 72 effected de-energizing of valve windings 38 and 40 which control gas valves 32 and 34, respectively. Thus, gas valves 32 and 34 should be closed, thereby preventing flow of gas to burner 28. If flame 42 is not present, as would be indicated by a digital low at pins G2 and G3, microcomputer M1 turns off inducer 18 in the event that it is on. As previously described, microcomputer M1 effects this function by providing a digital low at pin D1, which digital low effects de-energizing of relay coil 68 which controls relay contacts 20. After effecting turn off of inducer 18, microcomputer M1 checks whether the circulator blower off timer is timed out. The circulator blower off timer is an internal timer or counter in microcomputer M1 which is activated when flame 42 is extinguished. When the circulator blower off timer is timed out, microcomputer M1 turns off circulator blower 22. As previously described, microcomputer M1 effects this function by providing a digial low at pin L3, which digital low effects de-energizing of relay coil 66 which controls relay contacts 24.

It should be noted that the program logic of causing the circulator 22 to run until the circulator blower off timer is timed out is executed regardless of whether this program loop is entered as a result of the opening of the contacts of thermostat 72 upon completion of a normal burner cycle, or the opening of the contacts of limit device 70 due to an abnormally high temperature in the furnace plenum. Specifically, this program loop ensures that ciculator blower 22 will run for a desired amount of time, for example, 60 seconds, after flame 42 is extinguished. Normally, flame 42 is extinguished due to opening of the contacts of thermostat 72. Under this condition, circulator blower 22 effects distribution of the conditioned air which is in the furnace plenum, until the circulator blower off timer times out. It is to be understood that the time period established for the circulator blower off timer is such that the timer times out before the temperature of the distributed air drops to an uncomfortably cool temperature. If flame 42 is extinguished due to opening of the contacts of limit device 70, such opening being due to an abnormally high plenum air temperature caused by, for example, a clogged filter in the air distribution system, circulator blower 22 distributes the plenum air until the circulator blower off timer times out. Under this condition, it is believed that the time period established by the circulator blower off timer is sufficiently long to ensure that the circulator blower 22 is effective to cause the plenum air temperature to cool to an acceptable value.

If there is no call for heat and flame 42 is present, as would be indicated by a digital high at pins G2 and G3, flame 42 would be present due to a previous burner cycle. Specifically, if flame 42 is present, it would be present either because gas valve 32 and 34 have not yet closed due to an inherent slow-closing construction, or because both gas valves 32 and 34 are leaking a sufficient amount of gas past their valve seats to maintain a flame 42 of sufficient magnitude to be detected by flame probe 44. Regardless of the reason that flame 42 exists, the program advances to an inquiry as to whether inducer 18 and circulator blower 22 are on. If they are not on, microcomputer M1 turns them on by providing a digital high at pins L3 and D1 to effect energizing of relay coils 66 and 68 which, in turn, effect closing of relay contacts 24 and 20, respectively.

With inducer 18 and circulator blower 22 on, microcomputer M1 then sets an internal 2 second flame failure response time (FFRT) timer and starts an internal 30 second timer. The existence of flame 42 is checked during this 30 second time period. The 2 second FFRT timer necessitates flame 42 being absent for 2 seconds before flame 42 will be determined to be absent as indicated by a low at pins G2 and G3. Such a 2 second timer ensures that microcomputer M1 will not falsely interpret a momentary flame flicker or momentary non-impingement of flame probe 44 as an indication of the absence of flame 42. If absence of flame 42 is detected within the 30 second time period, the circulator blower off timer is started. Subsequently, microcomputer M1 effects turning off of inducer 18 and, after the circulator blower off timer is timed out, the turning off of circulator blower 22.

If flame 42 still exists at the end of the 30 second time period, the apparent reason for flame 42 is the gas valves 32 and 34 are leaking. Under this condition, the system enters lockout, a condition illustrated in FIG. 2I. In lockout, whether the lockout is caused by this condition or any other condition hereinafter described, microcomputer M1 provides the required signals to turn on inducer 18, turn on circulator blower 22, close gas valves 32 and 34, turn off igniter 26, and energize LED 3. When the system enters lockout due to gas valves 32 and 34 leaking, it is apparent that flame 42 will continue to exist. However, it should be noted that because gas valves 32 and 34 are in series, the likelihood of both gas valves 32 and 34 leaking sufficiently to sustain flame 42 is extremely remote. It should also be noted that while the use of LED 3 is preferred as an indication of system lockout, other means, such as an audible buzzer, could be used in lieu of or in addition to LED 3. As previously described, with resistor R63 not connected, as shown in FIG. 1B, the sysem can exit lockout by disconnecting the system from the power source at terminals 14 and 16 and then re-connecting the system. It is strongly recommended that, before re-connecting the system, the cause of the lockout condition be determined and corrected.

Referring again to FIG. 2A, if there is a call for heat, the next logic inquiry is whether a 30 second thermostat of timer is time out. As will hereinafter be described, this timer, which is an internal timer or counter in microcomputer M1, is activated when a call for heat is terminated. The timer prevents initiation of a new burner cycle immediately after thermostat 72 has opened to terminate a previous burner cycle.

Figure 2B:
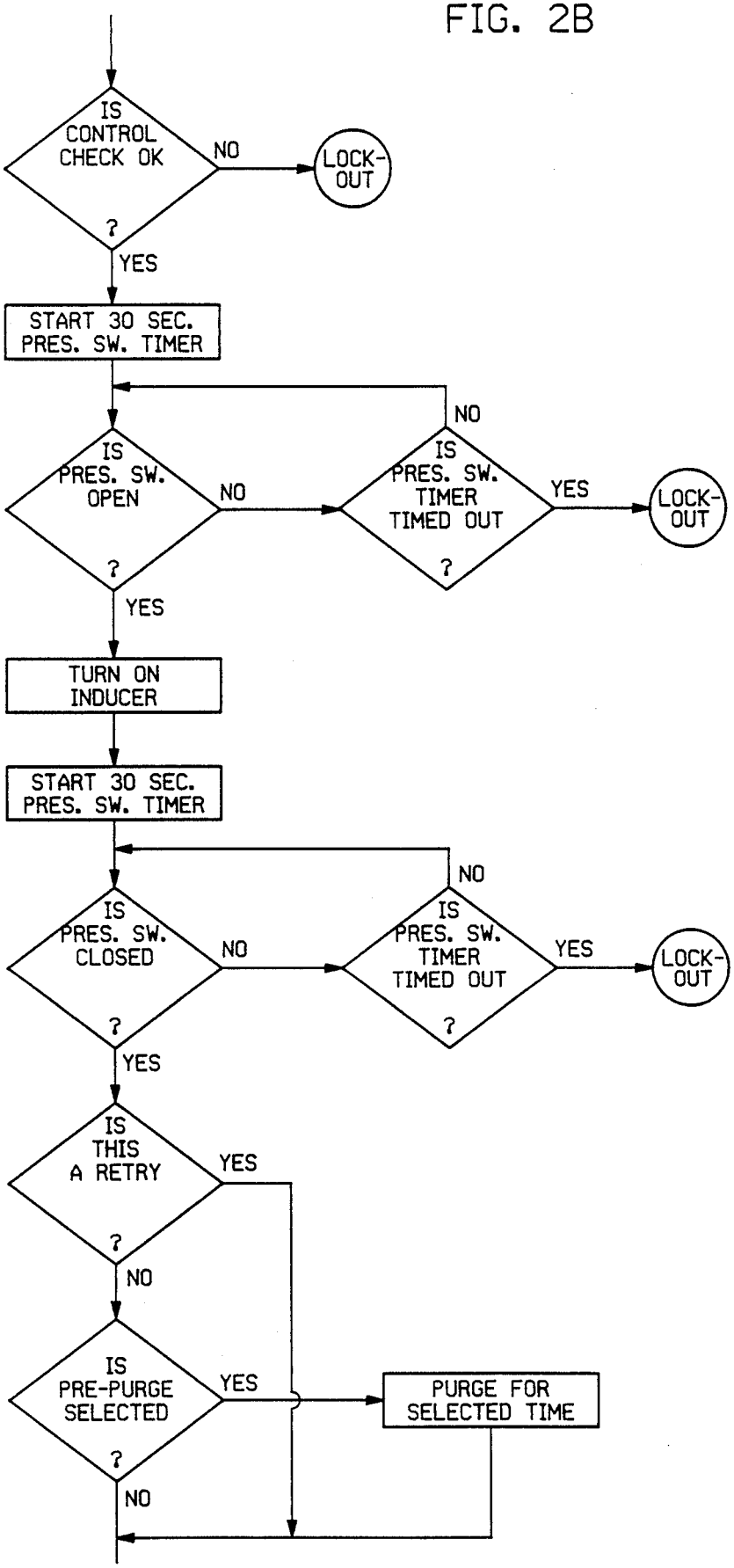

Referring the FIG. 2B, when the thermostat off timer is timed out, microcomputer M1 again performs various checks of ROM, RAM, and CPU, and causes lockout if the checks indicate a malfunction. This check is executed after the point START in the program logic so that it is executed on each call for heat. Accordingly, this check is different from the initial check performed one time immediately after initialization. For example, RAM is checked in such a manner that various data therein remains intact.

If the control check indicates that microcomputer M1 is functioning properly, it starts an internal 30 second pressure switch timer. Microcomputer M1 then checks the status of pin L0 to determine whether the contacts of pressure switch 102 are open. As previously described, when the contacts of pressure switch 102 are open, the signal at pin L0 is high; when closed, the signal at pin L0 is a 60 Hz square wave. Inducer 18 should be de-energized at this time, so that the contacts of switch 102 should be open. If the contacts of switch 102 are still closed at the end of the 30 second time period, the system enters lockout. A failure to open could be due to relay contacts 20 being welded closed so as to effect continued energizing of inducer 18, or due to a defect in pressure switch 102 which prevents its contacts from opening.

If the contacts in pressure switch 102 are open, microcomputer M1 then turns on inducer 18 and starts an internal 30 second pressure switch timer. Microcomputer M1 then checks the status of pin L0 to determine whether the contacts of pressure switch 102 subsequently close. If the contacts of switch 102 fail to close within the 30 second time period, the system enters lockout. A failure to close could be due to a number of causes, such as defective motor in inducer 18, a defective pressure switch 102, a defective relay coil 68, or a defect in the circuit that drives relay coil 68.

When the contacts in pressure switch 102 close, the next logic inquiry is whether this burner cycle is a retry. (Retry will hereinafter be described.) If the present burner cycle is not a retry, microcomputer M1 checks pins L4 and L5 to determine the time duration, if any, of pre-purge. As previously described, a digital high at pins L4 and L5, due to non-connection of resistors R67 and R66, respectively, establishes a pre-purge time of 30 seconds. Accordingly, microcomputer M1 effects energizing of inducer 18 for 30 seconds before advancing in the program. This pre-purge time enables inducer 18 to force out any accumulated unburned fuel or products of combustion from the combustion chamber of the furnace. As illustrated in FIG. 2A, if the present burner cycle is a retry, pre-purge is by-passed.

Figure 2C:
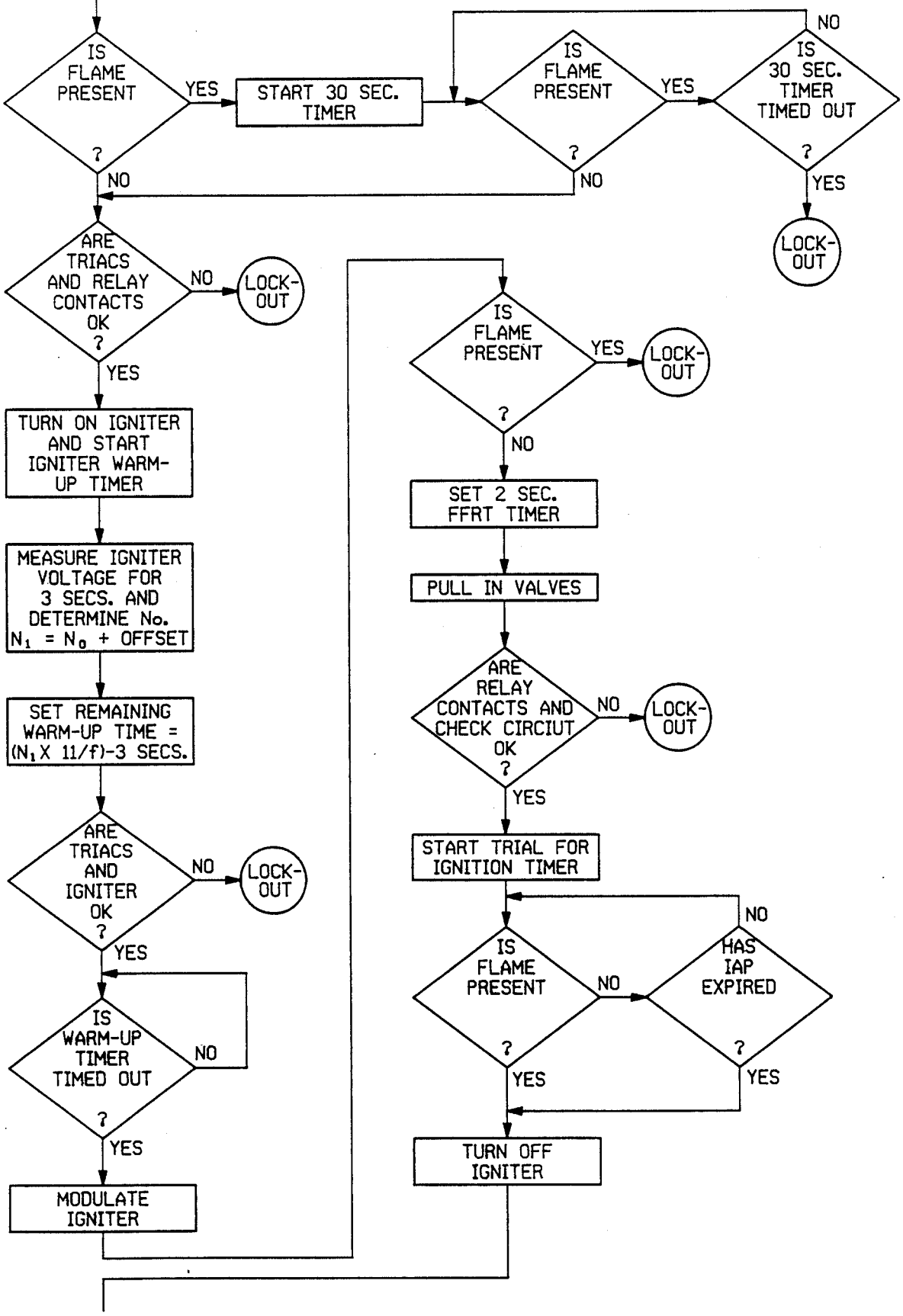

Referring to FIG. 2C, microcomputer M1 then checks whether flame 42 is present. This check ensures safe system operation in the event of a momentary power interruption during a normal burner cycle. Specifically, if gas valves 32 and 34 are slow-closing valves, and if there were no or insufficient pre-purge selected, a momentary power failure will de-energize valve windings 38 and 40, but valves 32 and 34 will remain open for a period of time. When power is resumed, there is still a call for heat. However, because the thermostat off timer was never activated, and because there may be no or insufficient pre-purge, there may have been insufficient time for flame 42 to extinguish. Therefore, in the event that flame 42 is present at this particular time in the program, microcomputer M1 starts an internal 30 second timer and (not shown) sets a 2 second flame failure response time (FFRT) timer. If flame 42 is no longer detected before the 30 second timer times out, the program advances; if flame 42 is still detected when the 30 second timer times out, a condition most likely due to leaking gas valves 32 and 34, the system enters lockout.

When flame 42 is not present, microcomputer M1 then checks relay contacts 112 and 116 and triacs Q1 and Q2 as previously described. If the checks disclose a malfunction, the system enters lockout. If the checks indicate no malfunctions, the program advances.

Mircrocomputer M1 then turns on triacs Q1 and Q2 so as to enable energizing of igniter 26, and concurrently, starts an internal igniter warm-up timer. As previously described, microcomputer M1 effects such turn on by providing a 120 Hz signals at pins D2 and D3. Triacs Q1 and Q2 are gated on each half-cycle of the 60 Hz line voltage so that igniter 26 is energized during each cycle of the line voltage.

Concurrently, microcomputer M1 measures voltage across igniter 26. As previously described, such measuring is effected by monitoring of pin G5. Based on such measured voltage, and in accordance with the formula $V=\sqrt{E^2\times N\times 1/f}$, microcomputer M1 determines the number of line voltage cycles that igniter 26 should be on, that is, the duty cycle, to effect the application of 80 volts across igniter 26. Microcomputer M1 effects this determination constantly during a 3 second time period. It is to be noted that igniter 26 is energized during each line voltage cycle during this 3 second time period.

As previously described, it has been determined than an applied voltage of 80 volts to igniter 26 will enable igniter 26 to attain and/or maintain a desired temperature of approximately 2175° F. However, due to tolerances in the manufacturing of igniter 26, and due to variations in the environment of igniter 26 in the application, it is necessary to adjust this 80 volt parameter.

Specifically, the duty cycle determined by microcomputer M1 in accordance with the formula $V=\sqrt{E^2\times N\times 1/f}$ is based on V being equal to 80 volts. This determined duty cycle is identified as duty cycle $N_0$. To compensate for the above mentioned tolerances and variations, microcomputer M1 determines an instant duty cycle, identified as duty cycle $N_1$, which is to be utilized in the present or instant burner cycle when duty cycling or modulation of igniter 26 is to begin. Specifically, microcomputer M1 determines the instant duty cycle $N_1$ by adding an offset value to the duty cycle $N_0$. Thus, when igniter 26 is duty cycled, the voltage across igniter 26 is not necessarily a constant voltage of 80 volts. Additionally, microcomputer M1 utilizes the offset value to determine the length of the warm-up time period. As will hereinafter be described more fully, this offset value functions to provide a learning routine so as to enable the eventual establishing of a desired operating temperature of igniter 26 which, preferably, is slightly above the lowest possible ignition temperature.

The offset value is a count in an internal counter of microcomputer M1 which can increment to a maximum count value, such as 14, and decrement to a minimum count value, such as −16. The initial count value, at initialization, is determined by the connection or non-connection of resistor R62 to pin I2. With resistor R62 connected, as shown in FIG. 1B, the initial count value is 4; if resistor R62 were not connected, the initial count value would be 9. The selection of one or the other of the initial count values is determined by the anticipated cooling effect on igniter 26 due to operation of inducer 18. It is to be noted that the cooling effect on igniter 26 can vary from furnace to furnace, depending on the capacity of inducer 18, the physical location of igniter 26 in the flow path of air or air-gas mixture and other such parameters. If the anticipated cooling effect is low, the initial count value of 4 would be chosen; if the anticipated cooling effect is high, the initial count value of 9 would be chosen.

After the above 3 second time period has expired, microcomputer M1 establishes the remaining warm up time as being: $(N_1\times 11/f)$ -3 seconds. For example, if the applied voltage to igniter 26 were 118 volts, the determined duty cycle $N_0$ would be 28. If this were the first duty cycle after initialization, the offset value would be 4, so that the instant or present duty cycle $N_1$ would be 28+4 which equals 32. The remaining warm-up time would therefore be $32\times 11/60)$ -3 which equals 2.87 seconds. Thus, for an additional 2.87 seconds, igniter 26 continues to be energized during each line voltage cycle.

When the additional 2.87 seconds time period begins, microcomputer M1 then checks for half-waving or shorted triacs Q1 and Q2 and for open or disconnected igniter 26 in the manner previously described. If the check indicates a malfunction, the system enters lockout.

When the igniter warm-up time times out, microcomputer M1 initiates modulation of igniter 26 by duty cycling igniter 26 at duty cycle $N_1$. Because igniter 26 has been energized each line voltage cycle by a sufficiently high voltage and for a sufficiently long warm-up time period, it is at a temperature sufficiently high to ignite gas, and modulation of igniter 26 at duty cycle $N_1$ is effective to maintain igniter 26 at such an ignition temperature.

While the method of modulation may take many forms, a preferred method, illustrated by an example, will now be described. In the above example, the duty cycle $N_1$ is 32. With the 60 Hz source, such a duty cycle establishes that the desired effective voltage across igniter 26 will be obtained if igniter 26 is energized for 32 of the 60 cycles existing in a 1 second time period, and de-energized for the remaining 28 cycles. The difference between the 32 "on" cycles and 28 "off" cycles is 4 cycles. When modulation begins, igniter 26 is energized by full line voltage for the first 4 cycles of the 60 cycles existing in a 1 second time period. In the remaining 56 cycles, igniter 26 is energized by alternate cycles of full line voltage and no voltage. Thus, 4 "on" cycles plus 28 (one half of 56) "on" cycles produces the required duty cycle $N_1$ of 32 "on" cycles. If the duty cycle $N_1$ were, for example, 28, igniter 26 would be energized by alternate cycles of full line voltage and no voltage for the first 56 cycles of the 1 second time period and, in the remainig 4 cycles, no voltage would be applied to igniter 26. It is believed that this method of modulation minimizes thermal shock to igniter 26.

Concurrent with initiating modulation, microcomputer M1 checks whether flame 42 is present. Flame should not be present since gas valves 32 and 34 are still closed. If flame 42 is present, both values 32 and 34 are leaking, and the system enters lockout.

If flame 42 is not present, microcomputer M1 sets an internal 2 second flame failure response time (FFRT) timer and effects energizing of valve windings 38 and 40 so as to pull in gas valves 32 and 34, respectively. As previously described, when energizing of valve windings 38 and 40 is desired, relay coils 108 and 110 are energized. Specifically, microcomputer M1 provides the 1K Hz signal at pin L1 which effects energizing of relay coil 108, and provides the constant digital high signal at pin L2 which effects energizing of relay coil 110. With relay coils 108 and 110 energized, relay contacts 112 and 116, respectively, close so as to enable energizing of valve windings 38 and 40.

In the manner previously described, microcomputer M1 then checks relay contact checking circuit 124, which check is also a check that both sets of normally-open relay contacts 112 and 116 are closed, and causes the system to enter lockout if the checks indicate a malfunction.

Microcomputer M1 then starts an internal trial for ignition timer. As previously described, with resistor R65 not connected, as shown in FIG. 1B, the time period is 4 seconds. The temperature of igniter 26 should be high enough to ignite the air-gas mixture at burner 28 so as to establish flame 42. Microcomputer M1 checks whether flame 42 is present, which presence would be indicated by a high at pins G2 and G3. Microcomputer M1 continues to check for a flame 42 until flame 42 appears or until a time period identified as the ignition activation period (IAP) has expired. The IAP is established by an internal counter which is initiated at the start of the trial for ignition timer. The IAP timer times out at a time determined by the selected trial for ignition time. For example, with a selected trial for ignition time of 4 seconds, the IAP times out 2 seconds after the trial for ignition timer is started. If the selected trial for ignition time were 7 seconds, the IAP would time out 5 seconds after the trial for ignition timer is started.

Figure 2D:
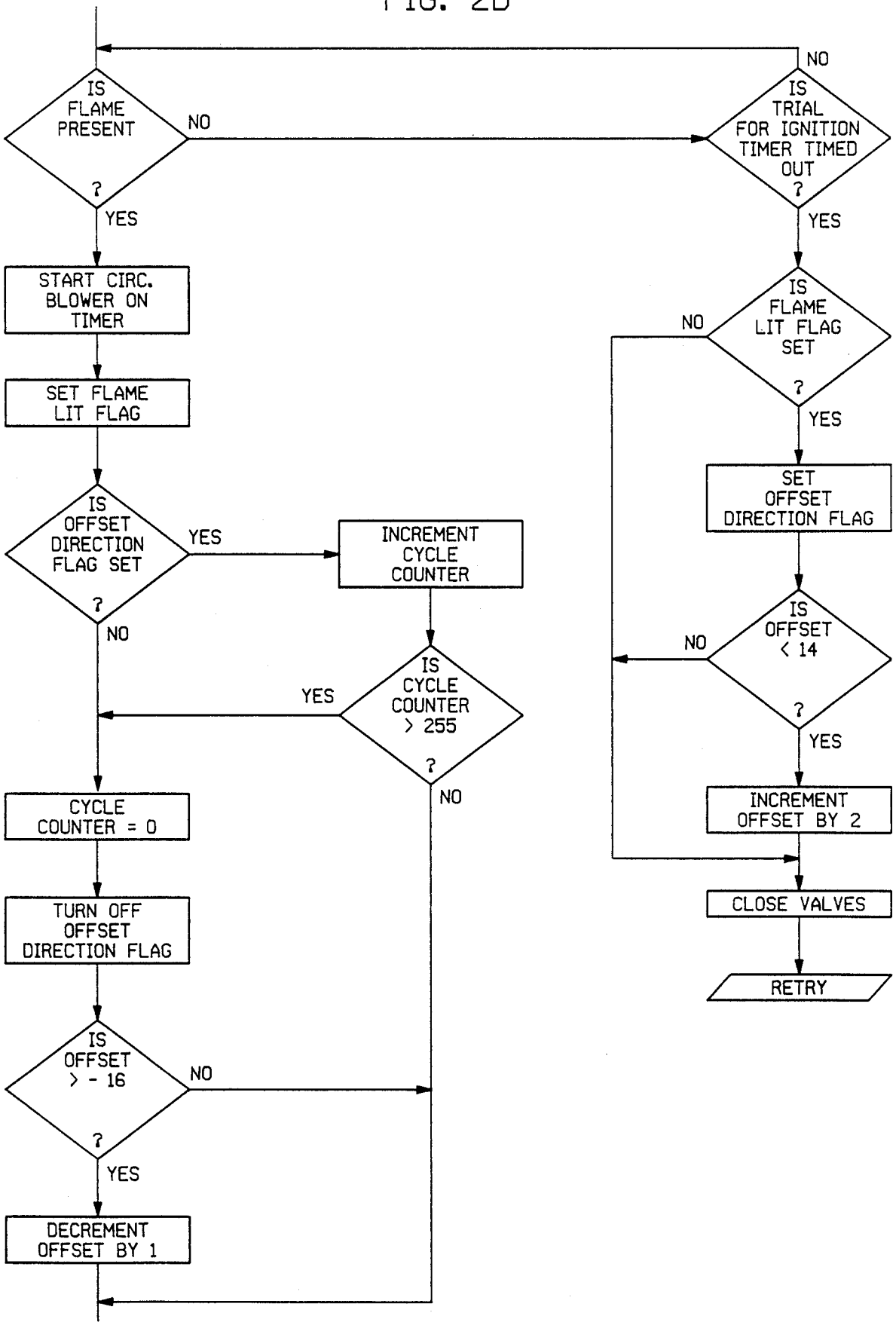

When flame 42 is detected, or if there is no flame 42 and the IAP has expired, microcomputer M1 effects de-energizing of igniter 26. Referring to FIG. 2D, microcomputer M1 then continues to check for the presence of flame 42 until flame 42 is detected or until the 4 second trial for ignition timer times out.

If flame 42 is detected within the 4 second trial for ignition time period, microcomputer M1 then starts an internal circular blower on timer. For example, the circulator blower on timer might be set for 30 seconds. With such a timing, circulator blower 22 is turned on 30 seconds after flame 42 is detected so as to distribute the plenum air heated by flame 42.

Concurrently, microcomputer M1 sets an internal flag identified as flame lit flag. This flag indicates that flame 42 has been established. Microcomputer M1 then checks if another flag, identified as offset direction flag, has been set. This offset direction flag is set only if there has been an unsuccessful attempt for ignition after there has been a successful ignition. Specifically, if this is the first attempt for ignition since initialization or if every attempt for ignition since initialization has been successful, the offset direction flag is not set. Under this condition, an internal counter, identified as cycle counter, is zero, and the offset direction flag is off. Microcomputer M1 then checks if the offset count is greater than $-16$. If the offset count is greater than $-16$, the count is decremented by a value of 1; if the offset count is not greater than $-16$, offset count value is left unchanged. Thus, for example, if the present burner cycle is the tenth cycle since initialization, and all previous 9 burner cycles have been successful, and the initial offset value was 4, the offset value would have decremented, by the ninth cycle, to a value of $-5$ which value is greater than $-16$. Thus, in the tenth cycle, the offset value would be further decremented to a value of $-6$.

If the offset direction flag is set, the cycle counter is incremented. If the value of the cycle counter is greater than 255, the cycle counter is set to zero and the offset direction flag is turned off. This enables the offset count value to be decremented. If the value of the cycle counter is not greater than 255, the program bypasses the offset decrementing step. As will be explained more clearly hereinafter, the cycle counter program loop provides a low rate oscillator which ensures that igniter 26 will not be locked into a higher than desired operating temperature.

If flame 42 is not detected within the 4 second trial for ignition time period, microcomputer M1 checks if the flame lit flag is set. If the flame lit flag is not set, indicating that there has been no successful ignition since initialization, microcomputer M1 effects closing of valves 32 and 34, and the system enters a retry subroutine shown in FIG. 2G.

In retry, microcomputer M1 increments an internal retry counter. If the count in the retry counter is 3, indicating that there have been 3 successive unsuccessful attempts at ignition, the system enters lockout. If the count is less than 3, microcomputer M1 sets an internal timer to provide 30 seconds of purging by inducer 18. Thus, for 30 seconds, inducer 18 is energized so that any unburned fuel that may have accumulated in the combustion chamber during the 4 second trial for ignition time period is safely exhausted. When the 30 seconds expires, inducer 18 is turned off, and the program returns to START.

If the flame lit flag is set, indicating that there has been a previous successful ignition, the offset direction flag is then set. Microcomputer M1 then checks if the offset count is less than 14. If the offset count is less than 14, the count is incremented by a value of 2; if the offset count is not less than 14, the offset count is left unchanged. In either case, microcomputer M1 then effects closing of valves 32 and 34, and the system enters retry.

The above described logic of incrementing and/or decrementing the offset counter provides a learning routine for enabling the establishing of a desired ignition temperature which is slightly above the lowest possible temperature at igniter 26 which will enable it to ignite the air-gas mixture. Specifically, in the first burner cycle after initialization, the duty cycle $N_1$ and the length of the warm-up time are established such that igniter 26 is heated to a temperature considerably above the lowest possible ignition temperature so as to ensure that ignition will occur. During the first burner cycle, wherein flame 42 is established, the offset count is decremented, resulting in a lower duty cycle $N_1$ and a shorter warm-up time for the next burner cycle. Such a lower duty cycle $N_1$ causes a decrease in the effective voltage across igniter 26 in the next burner cycle and, in conjuction with the shorter warm-up time, a decrease in the temperature of igniter 26. Such decrementing continues each successive burner cycle in which ignition is successful, until igniter 26 is no longer hot enough to ignite the air-gas mixture. In the burner cycle in which igniter 26 fails to provide ignition, the offset direction flag is set and the offset count is incremented by 2 so that on the next burner cycle, igniter 26 will again be hot enough to provide ignition. Due to the setting of the offset direction flag and the provision of the cycle counter, decrementing of the offset count will not occur until the cycle counter exceeds a count value of 255. Thus, for the next 255 burner cycles, if ignition is successful in every cycle, decrementing of the offset count is prevented. Thus, if a failure to ignite after one or more successful burner cycles is truly due to igniter 26 no longer being hot enough, the subsequent burner cycle, due to the incrementing by 2 of the offset value, will again effect an increase in the temperature of igniter 26 so as to enable it to effect ignition. The system then operates at the increased igniter temperature during the next 255 burner cycles. When the cycle counter exceeds the value of 255, the cycle counter is reset to zero, the offset direction flag is turned off, and decrementing of the offset count can then again be effected. Thus, if the prior failure to ignite was due to a factor other than igniter 26 not being hot enough, for example, due to low gas pressure, the system is not locked in a warm-up time of such duration and such modulation which would effect a higher than necessary igniter temperature.

It is to be noted that incrementing the offset by 2 counts overcompensates slightly for the decrease in igniter temperature effected by the previous decrementing by 1 count. That is to say, if the offset were incremented by only 1 count instead of 2, igniter 26 would then truly be at the lowest possible ignition temperature since ignition had occurred in the previous burner cycle before the offset count had been decremented by 1 count. However, the increase in the temperature of igniter 26, due to the additional 1 count is relatively small so that, with such a 2 count incrementing, igniter 26 is essentially at its lowest possible ignition temperature. Furthermore, it is to be understood that while incrementing by 2 counts is preferred so as to establish essentially the lowest possible ignition temperature, the logic could be such that it could effect incrementing by more than 2 counts so as to establish some other desired ignition temperature which is higher than the lowest possible ignition temperature but still below the previously described maximum allowable temperature of 2325° F. The essential logic, whether the desired ignition temperature to be established is the lowest possible temperature or a higher temperature, is determining a level of energizing of igniter 26 at which it is no longer capable of effecting ignition, and thereafter increasing the level of energizing of igniter 26 to enable igniter 26 to again effect ignition.

Figure 2E:
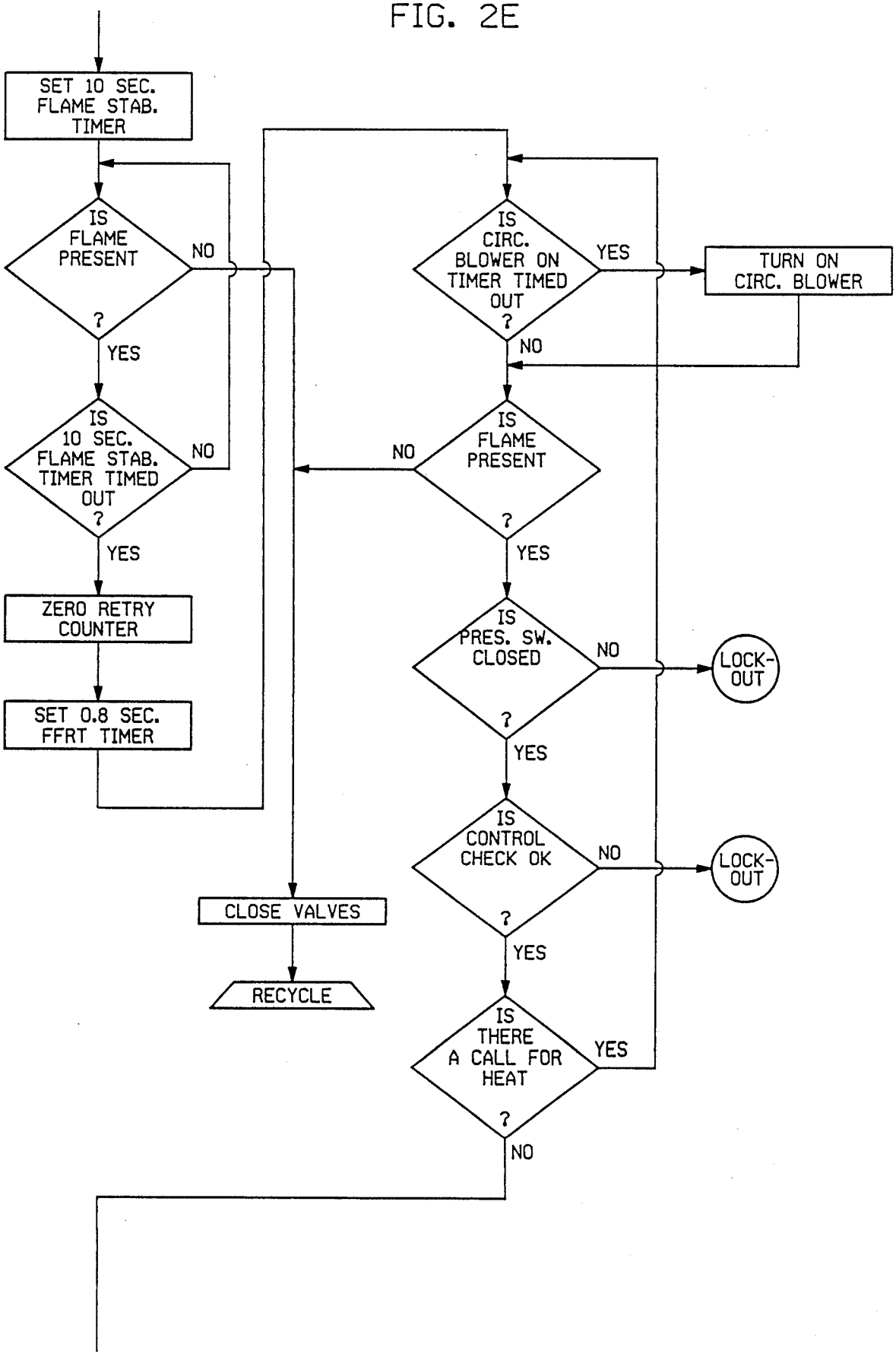

Referring to FIG. 2E, if burner flame 42 exists, microcomputer M1 sets an internal 10 second flame stabilization timer. During this 10 second time period, microcomputer M1 checks for presence of flame 42 as would be indicated by a high signal at pins G2 and G3. At this time, the flame failure response time (FFRT) is 2 seconds. Therefore, if flame 42 is erratic, as it may be at the initiation of flame 42, and is not sufficiently stable to constantly impinge flame probe 44, microcomputer M1 will not interpret such non-impingement as a flame failure unless the non-impingement lasts for the FFRT of 2 seconds. If a flame failure of 2 seconds duration is detected, as would be indicated by a low signal at pins G2 and G3, microcomputer M1 effects closing of valves 32 and 34, and the system enters a recycle subroutine shown in FIG. 2H. (The recycle subroutine will hereinafter be described.)

If flame 42 still exists after the 10 second flame stabilization timer times out, microcomputer M1 then zeros or clears the retry counter and sets an internal 0.8 second flame failure response time (FFRT) timer. Thus, subsequent to this time in the burner cycle, a flame failure of 0.8 seconds duration will be detectable.

Microcomputer M1 then checks if the circulator blower on timer, which was started when flame 42 first appeared, has timed out. If the timer has timed out, microcomputer M1 effects turn on of circulator blower 22. Regardless of whether circulator blower 22 is turned on or not, microcomputer M1 proceeds to an inquiry as to whether flame 42 is present.

If flame 42 continues to exist, microcomputer M1 then checks pressure switch 102 to ensure that inducer 18 is still turned on. If pressure switch 102 is open, the system enters lockout.

If pressure switch 102 is closed, microcomputer M1 then performs another control check. If the control check indicates a malfunction, the system enters lockout; if the control check indicates that microcomputer M1 is functioning properly, microcomputer M1 remains in the program loop shown in FIG. 2E so long as there is a call for heat. That is to say, so long as the contacts of thermostat 72 and limit device 70 remain closed, microcomputer M1 continues to check whether the circulator blower on timer is timed out and to turn on circulator blower 22 if the on timer times out, continues to monitor flame 42, continues to monitor pressure switch 102, and continues to perform the control check.

Figure 2F:
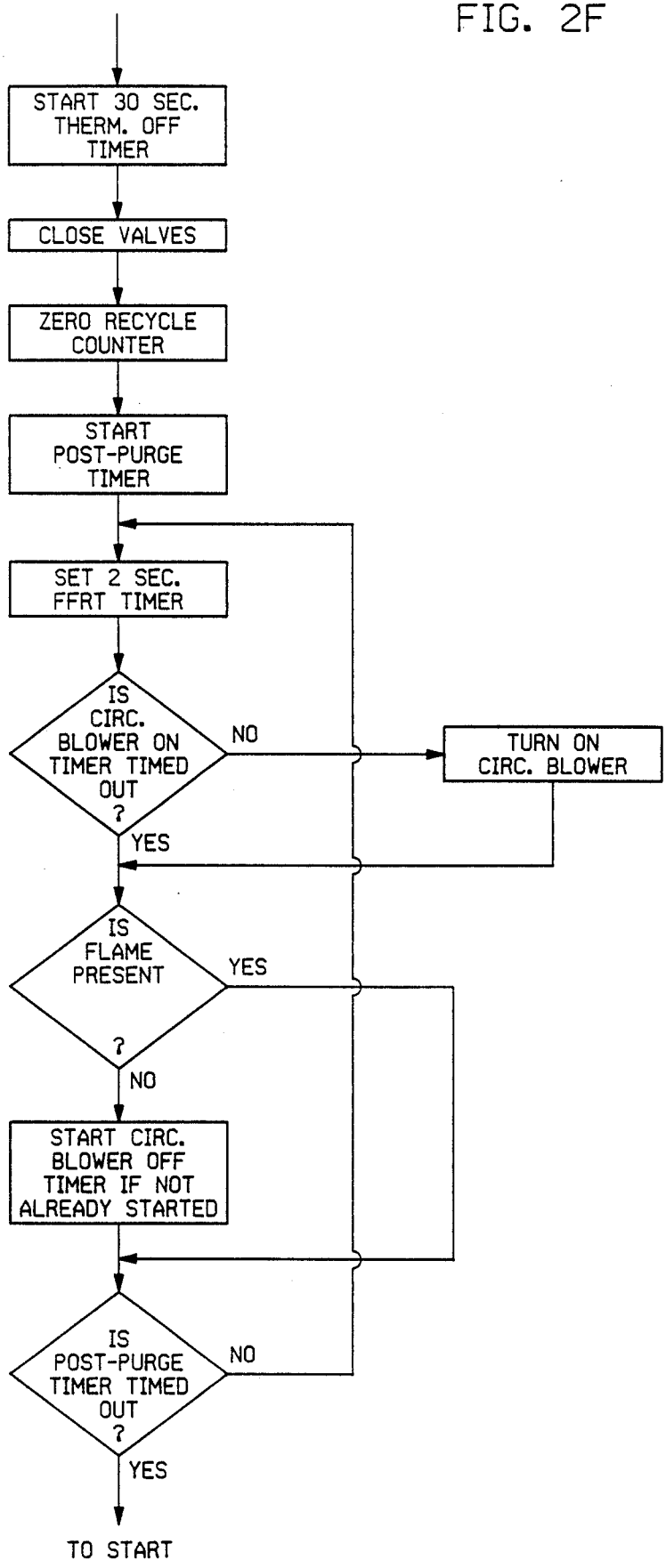
Figure 2G:
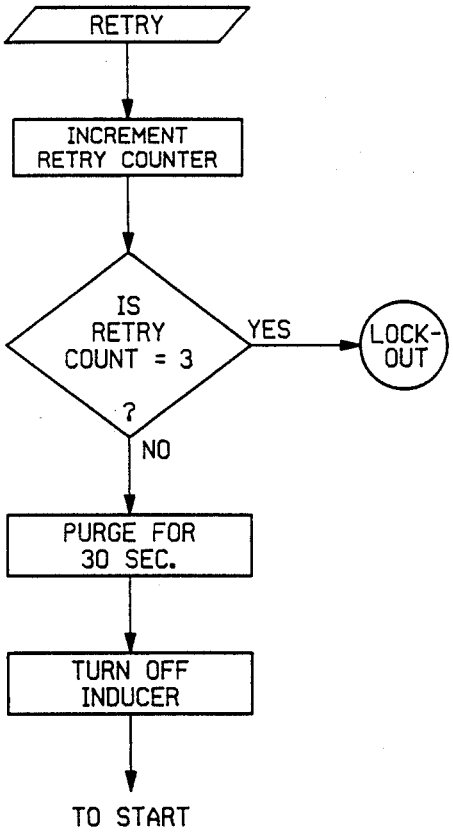
Figure 2H:
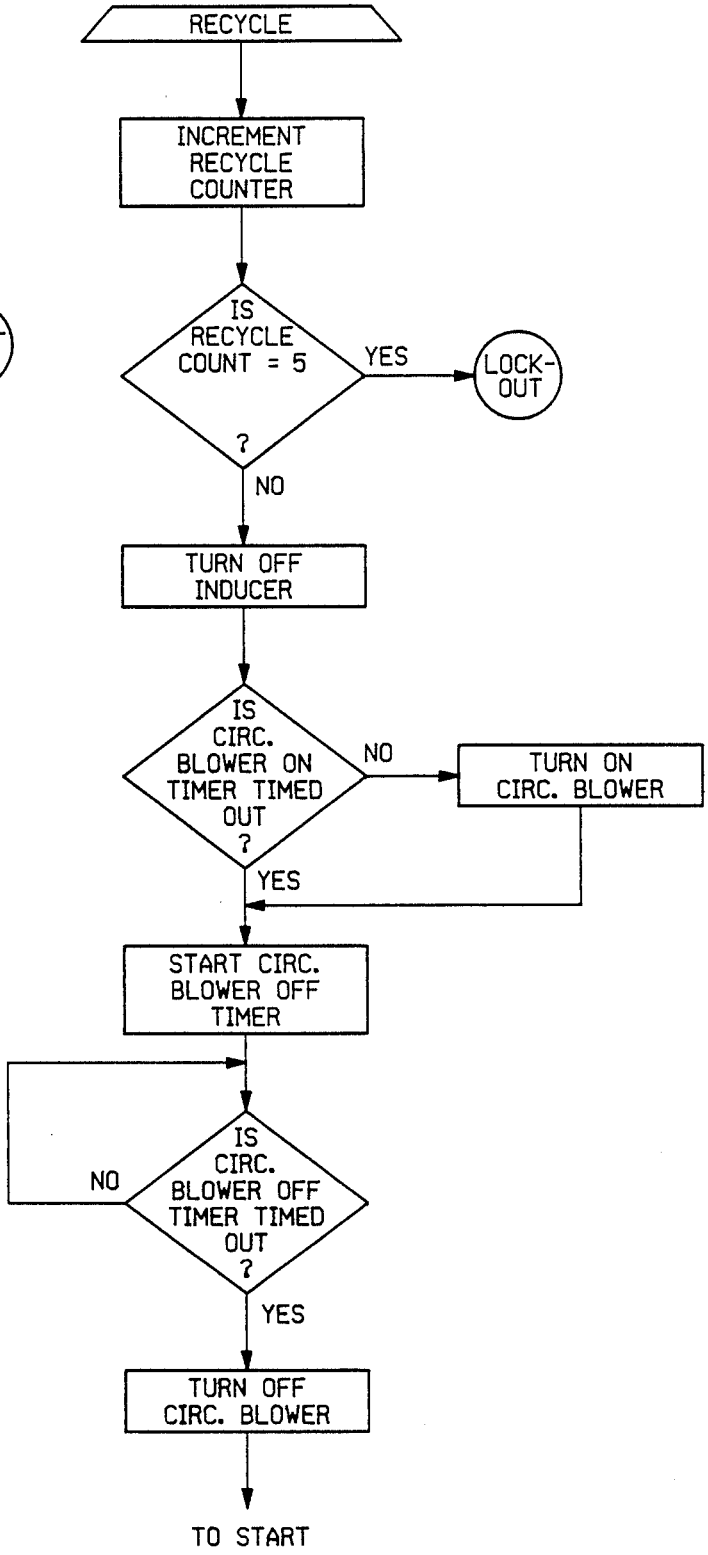
Figure 2I:
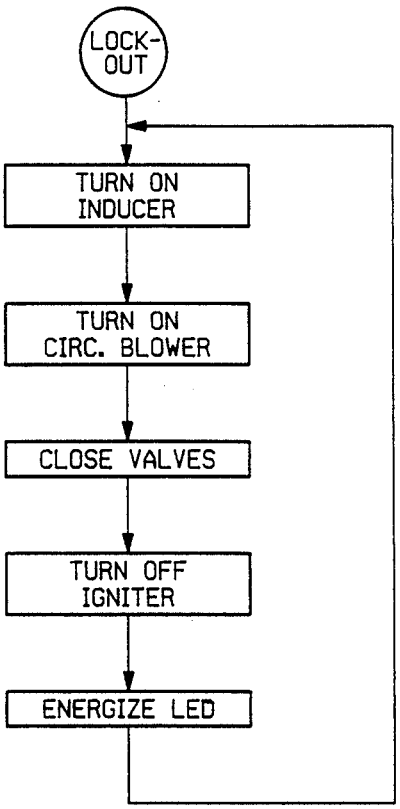

If flame 42 is lost while there is still a call for heat, microcomputer M1 effects closing of valves 32 and 34, and the system enters recycle. In the recycle subroutine, as shown in FIG. 2H, microcomputer M1 increments an internal recycle counter. If the count in the recycle counter is 5, indicating that there have been 5 successive failures sustain flame 42 either during or after the 10 second flame failure stabilization time period, the system enters lockout. If the count in the recycle counter is less than 5, microcomputer M1 effects the turn off of inducer 18. Microcomputer M1 then checks whether the circulator blower on timer is timed out. If the circulator blower on timer is timed out, circulator blower 22 is on; if the circulator blower on timer is not timed out, microcomputer M1 effects turn on of circulator blower 22. Microcomputer M1 then starts the circulator blower off timer. When the circulator blower off timer times out, microcomputer M1 effects turn off of circulator blower 22, and the system returns to START. It is to be noted that causing circulator blower 22 to run for the blower off timer timing before returning to START, ensures reliable system operation. Specifically, if the system returns to START due to loss of flame 42, and if circulator blower 22 had not run for its off timer timing, the air in the furnace plenum may be hot enough to cause the contacts of limit device 70 to open, thus unnecessarily delaying the initiation of a proper burner cycle; or circulator blower 22 may be on at times in the subsequent burner cycle when it is desired that circulator blower 22 be off.

Under normal system operation, when thermostat 72 is satisfied, it opens its contacts, thus terminating a call for heat. It is to be noted that a call for heat can also be terminated by opening of the contacts of limit device 70, which opening would be caused by over-heating of the plenum air due to an abnormal condition. Regardless of whether the call for heat is terminated by thermostat 72 or limit device 70, microcomputer M1, as shown in FIG. 2F, starts an internal 30 second thermostat off timer and effects closing of gas valves 32 and 34. Microcomputer M1 then zeros or clears the recycle counter.

Microcomputer M1 then executes a post-purge function. Specifically, due to the non-connection of resistor R60, the programmed post-purge time period is 20 seconds. Microcomputer M1 thus starts an internal 20 second timer. Microcomputer M1 also sets an internal 2 second flame failure response time (FFRT) timer. Thus, during the 20 second post-purge time period, a flame of 2 seconds duration will be detectable.

Microcomputer M1 then checks whether the circulator blower on timer is timed out. If the circulator blower on timer is timed out, circulator blower 22 is on; if the circulator blower on timer is not timed out, microcomputer M1 effects turn on of circulator blower 22. Microcomputer M1 then checks if flame 42 is present. If flame 42 is absent, as it should be since gas valves 32 and 34 are closed, microcomputer M1 starts the circulator blower off timer. When the post-purge time period expires, the system returns to START. As previously described in reference to FIG. 2A, microcomputer M1 then effects turn off of inducer 18 and, after the circulator blower off timer has timed out, turn off of circulator blower 22.

If flame 42 is present during the post-purge time period, microcomputer M1 continues to check flame 42 until the post-purge timer times out. If flame 42 becomes absent within the post-purge time period, microcomputer M1 starts the circulator blower off timer. When the post-purge time period expires, the system returns to START.

If flame 42 is still present at the end of the post-purge time period, it would be present either because gas valve 32 and 34 have not yet closed due to an inherent slow-closing construction, or because both gas valves 32 and 34 are leaking a sufficient amount of gas past their valve seats to maintain a flame 42 of sufficient magnitude to be detected by flame probe 44. As previously described in reference to FIG. 2A, when the system returns to START, microcomputer M1 then checks flame 42 for an additional 30 seconds. If flame 42 becomes absent during this 30 second time period, the circulator blower off timer is started. Microcomputer M1 then effects turn off of inducer 18 and, after the circulator blower off timer has timed out, turn off of circulator blower 22. If flame 42 still exists after the 30 second timer has timed out, the system enters lockout.

The following components are deemed to be suitable for use in the system described herein.

| Component | Type |
|---|---|
| M1 | COP881 |
| A1, A2 | LM2904 |
| Q1, Q2 | Z0410BE |
| Q3–Q6, Q8, Q9, Q11, Q13 | 2N6428 |
| Q7 | MPS-A42 |
| VR1 | 1N5994 |
| VR2 | 1N6007 |
| VR3 | 1N6005 |
| VR4 | 1N5992C |
| Inverter 60,84, 106, 128, 132,134 | 4049 |
| Opto-triac 140, 142 | MOC3009 |
| CR1–CR14 | 1N4004 |
| R1, R2, R3, R19 | 1M |
| R4 | 10M |
| R5, R60–R67 | 3.9k |
| R6, R7, R32, R47, R50 | 100k |
| R8, R26, R36 | 51k |
| R9 | 510k |
| R10 | 200k |
| R11, R12 | 120k |
| R13–R17, R51, R55 | 91 ohms |
| R18, R24, R25, R31, R33, R48, R58 | 10k |
| R20, R22, R34 | 430 ohms |
| R21, R23, R35, R54, R59 | 5.6k |
| R27, R37 | 20k |
| R28, R52, R56, R68 | 1k |
| R29 | 560 ohms |
| R30 | 3.3k |
| R38, R39 | 20M |
| R40, R43 | 226k |
| R41, R44 | 287k |
| R42, R45 | 21k |
| R46 | 2.2k |
| R49 | 68k |
| R53, R57 | 360 ohms |
| C1 | .001 Mfd. |
| C2 | 1000 Mfd. |
| C3 | 300 Pfd. |
| C4 | 33 Mfd. |
| C5, C16 | .033 Mfd. |
| C6, C11, C12, C18 | 47 Mfd. |
| C7 | 3.3 Mfd. |
| C8 | .1 Mfd. |
| C9, C10 | 30 Pfd. |
| C13 | .047 Mfd. |
| C14 | 22 Mfd. |
| C15 | 10 Mfd. |
| C17, C21 | .0015 Mfd. |
| C19, C20 | .022 Mfd. |
| C22 | .22 Mfd. |

While the invention has been illustrated and described in detail in the drawings and foregoing description, it will be recognized that many changes and modifications will occur to those skilled in the art. It is therefore intended, by the appended claims, to cover any such changes and modification as fall within the true spirit and scope of the invention.

We claim:

1. In a fuel burner control system,
a burner;
valve means controlling the flow of fuel to said burner;
an igniter for igniting said fuel at said burner;
means for sensing flame at said burner;
a circulator blower for distributing air; heated by said flame
means for establishing a call for heat; and
means responsive to a sensed flame during a time when there is no call for heat for effecting energizing of said circulator blower.

2. The control system claimed in claim 1 further including means responsive to initial sensing of said flame during said call for heat for initiating a circulator blower on timer and for effecting energizing of said circulator blower when said on timer times out.

3. The control system claimed in claim 2 wherein said means responsive to a sensed flame during a time when there is no call for heat includes means for effecting initial energizing of said circulator blower in the event said circulator blower on timer is not timed out.

4. The control system claimed in claim 2 further including means responsive to termination of said call for heat for effecting initial energizing of said circulator blower in the event said circulator blower on timer is not timed out, and means responsive to loss of flame upon said termination of said call for heat for initiating a circulator blower off timer and for effecting de-energizing of said circulator blower when said off timer times out.

* * * * *

UNITED STATES PATENT AND TRADEMARK OFFICE

CERTIFICATE OF CORRECTION

PATENT NO. : 4,978,292

DATED : December 18, 1990

INVENTOR(S) : Donald E. Donnelly et al.

It is certified that error appears in the above-identified patent and that said Letters Patent is hereby corrected as shown below:

Col. 27, line 10, after "air" delete--;--;
line 11, after "flame" insert--;--.

Signed and Sealed this

Twenty-eighth Day of July, 1992

*Attest:*

DOUGLAS B. COMER

*Attesting Officer*

*Acting Commissioner of Patents and Trademarks*